US005806506A

United States Patent [19]

Kitamura et al.

[11] Patent Number: 5,806,506

[45] Date of Patent: Sep. 15, 1998

[54] CYLINDER-BY-CYLINDER AIR-FUEL RATIO-ESTIMATING SYSTEM FOR INTERNAL COMBUSTION ENGINES

[75] Inventors: Toru Kitamura; Hiroshi Ohno; Yusuke Hasegawa; Yoichi Nishimura; Kenichiro Ishii, all of Wako, Japan

[73] Assignee: Honda Giken Kogyo Kabushiki Kaisha, Tokyo, Japan

[21] Appl. No.: 900,879

[22] Filed: Jul. 25, 1997

[30] Foreign Application Priority Data

Aug. 1, 1996 [JP] Japan ..... 8-218144
Aug. 29, 1996 [JP] Japan ..... 8-245464

[51] Int. Cl.[6] ..... F02D 41/14

[52] U.S. Cl. ..... 123/673; 123/687; 123/694; 701/109

[58] Field of Search ..... 123/673, 687, 123/694; 60/276; 701/109

[56] References Cited

U.S. PATENT DOCUMENTS 5,623,913 4/1997 Kitajima et al. ..... 123/687 X
5,636,621 6/1997 Maki et al. ..... 123/673

FOREIGN PATENT DOCUMENTS 5-180059 7/1993 Japan .
7-259588 10/1995 Japan .

*Primary Examiner*—Tony M. Argenbright
*Attorney, Agent, or Firm*—Nikaido, Marmelstein, Murray & Oram LLP

[57] ABSTRACT

A cylinder-by-cylinder air-fuel ratio-estimating system for an internal combustion engine includes an air-fuel ratio sensor arranged in the exhaust system of the engine, at a confluent portion of the exhaust system. The air-fuel ratio of a mixture supplied to each of the cylinders is estimated based the output from the air-fuel ratio sensor, by using an observer for observing the internal operative state of the exhaust system based on a model representative of the behavior of the exhaust system. The air-fuel ratio at the confluent portion is estimated by using a delay parameter representative of the response delay of the air-fuel ratio sensor, and the air-fuel ratio of the mixture supplied to each of the cylinders is estimated by using the estimated air-fuel ratio at the confluent portion. The estimated air-fuel ratio of the mixture supplied to each of the cylinders is subsequently used for estimating a value of the air-fuel ratio at the confluent portion of the exhaust system.

7 Claims, 22 Drawing Sheets

TDC SIGNAL PULSES

A/F AT CONFLUENT PORTION

OPTIMUM
SAMPLING TIMING
BAD
SAMPLING TIMING

ACTUAL A/F

A/F RECOGNIZED
BY ECU

CYLINDER-BY-CYLINDER AIR-FUEL RATIO-ESTIMATING SYSTEM FOR INTERNAL COMBUSTION ENGINES

BACKGROUND OF THE INVENTION

1. Field of the Invention

This invention relates to a cylinder-by-cylinder air-fuel ratio-estimating system for internal combustion engines, which estimates the air-fuel ratio of a mixture supplied to each of cylinders of the engine by applying an observer based on a modern control theory.

2. Prior Art

Conventionally, there is known a cylinder-by-cylinder air-fuel ratio-estimating method for internal combustion engines, for example, from Japanese Laid-Open Patent Publication (Kokai) No. 5-180059, according to which an observer is set for observing the internal operative state of the exhaust system, based on a model describing the behavior of the exhaust system, and the air-fuel ratio of a mixture supplied to each of cylinders of the engine is estimated based on an output from an air-fuel ratio sensor arranged in the exhaust system at a confluent portion thereof, for generating an output proportional to the air-fuel ratio.

Air-fuel ratio sensors in general have a delay of response, and if estimation of the air-fuel ratio of the mixture supplied to each of the cylinders is carried out without compensating for the delay of response, the accuracy of the estimation is degraded. To overcome this inconvenience, in the known method a model representative of the operation of the air-fuel ratio sensor is prepared based on the assumption that the air-fuel ratio sensor is a system of delay of the first order, and an inverse transfer function is obtained based on a transfer function of the model, followed by multiplying the sensor output by the thus obtained inverse transfer function, to thereby compensate for the delay of response of the sensor.

Further, an air-fuel ratio-detecting system for internal combustion engines is conventionally known, for example, from Japanese Laid-Open Patent Publication (Kokai) No. 7-259588, which samples the output from the air-fuel ratio sensor whenever the crankshaft of the engine rotates through a predetermined degree, sequentially stores the sampled output values, and selects an optimum output value from the stored sampled output values, according to operating conditions of the engine, to thereby sample the output from the air-fuel ratio sensor at the optimum timing.

The known method according to Japanese Laid-Open Patent Publication (Kokai) No. 5-180059, however, has the disadvantage that the output from the air-fuel ratio sensor is susceptible to the influence of noises and therefore remains to be improved.

On the other hand, the known air-fuel ratio-detecting system according to Japanese Laid-Open Patent Publication (Kokai) No. 7-259588 does not contemplate deterioration of the response characteristic of the air-fuel ratio sensor due to aging, etc. If the air-fuel ratio sensor has a deteriorated response characteristic, the sensor output cannot be sampled at the optimum timing. As a result, if the air-fuel ratio of the mixture supplied to each of the cylinders is estimated based on the sampled output from the air-fuel ratio sensor with the deteriorated response characteristic, the estimated air-fuel ratio is not accurate.

SUMMARY OF THE INVENTION

It is a first object of the invention to provide a cylinder-by-cylinder air-fuel ratio-estimating system for internal combustion engines, which is capable of properly compensating for the delay of response of the air-fuel ratio sensor, to thereby accurately estimate the air-fuel ratio of a mixture supplied to each of the cylinders of the engine, and further is not susceptible to the influence of noises.

It is a second object of the invention to provide a cylinder-by-cylinder air-fuel ratio-estimating system for internal combustion engines, which is capable of properly compensating for the deterioration of the response characteristic of the air-fuel ratio sensor, to thereby maintain good estimation accuracy of the air-fuel ratio of a mixture supplied to each of the cylinders over a long time.

To attain the first object, according to a first aspect of the invention, there is provided a cylinder-by-cylinder air-fuel ratio-estimating system for an internal combustion engine having a plurality of cylinders, and an exhaust system including at least one confluent portion, the cylinder-by-cylinder air-fuel ratio-estimating system including air-fuel ratio-detecting means arranged in the exhaust system at the confluent portion, and cylinder-by-cylinder air-fuel ratio-estimating means for estimating an air-fuel ratio of a mixture supplied to each of the cylinders, based on an output from the air-fuel ratio-detecting means, by using an observer for observing an internal operative state of the exhaust system based on a model representative of a behavior of the exhaust system.

The cylinder-by-cylinder air-fuel ratio-estimating system is characterized by an improvement wherein:

the cylinder-by-cylinder air-fuel ratio-estimating means includes confluent portion air-fuel ratio-estimating means for estimating an air-fuel ratio at the confluent portion of the exhaust system by using a delay parameter representative of a response delay of the air-fuel ratio-detecting means, the cylinder-by-cylinder air-fuel ratio-estimating means estimating the air-fuel ratio of the mixture supplied to the each of the cylinders by using an output from the confluent portion air-fuel ratio-estimating means, the estimated air-fuel ratio of the mixture supplied to the each of the cylinders being subsequently used for estimating a value of the air-fuel ratio at the confluent portion of the exhaust system.

Preferably, the cylinder-by-cylinder air-fuel ratio-estimating means estimates the air-fuel ratio of the mixture supplied to the each of the cylinders, based on a difference between the output from the air-fuel ratio-detecting means and the output from the confluent portion air-fuel ratio-estimating means.

Also preferably, the observer of the cylinder-by-cylinder air-fuel ratio-estimating means observes an air-fuel ratio of an air-fuel mixture supplied to ones of the cylinders connected to the confluent portion of the exhaust system and the air-fuel ratio at the confluent portion of the exhaust system.

More preferably, the confluent portion air-fuel ratio-estimating means estimates the air-fuel ratio at the confluent portion by using a delay time constant as the delay parameter, the delay time constant being set according to at least rotational speed of the engine.

To attain the second object, according to a second aspect of the invention, there is provided a cylinder-by-cylinder air-fuel ratio-estimating system for an internal combustion engine having a plurality of cylinders, a crankshaft, and an exhaust system including at least one confluent portion, the cylinder-by-cylinder air-fuel ratio-estimating system including air-fuel ratio-detecting means arranged in the exhaust system at the confluent portion, and cylinder-by-cylinder air-fuel ratio-estimating means for estimating an air-fuel ratio of a mixture supplied to each of the cylinders, based on an output from the air-fuel ratio-detecting means, by using an observer for observing an internal operative state of the exhaust system based on a model representative of a behavior of the exhaust system.

The cylinder-by-cylinder air-fuel ratio-estimating system is characterized by an improvement comprising:

sampling means for sampling the output from the air-fuel ratio-detecting means whenever the crankshaft rotates through predetermined rotational degrees, and sequentially storing sampled output values obtained by the sampling;

selecting means for determining a value of sampling timing according to operating conditions of the engine, and selecting one of the stored sampled output values corresponding to the determined value of sampling timing;

deterioration parameter-calculating means for calculating a deterioration parameter representative of deterioration of a response characteristic of the air-fuel ratio-detecting means; and delay parameter-calculating means for calculating a delay parameter representative of a response delay of the air-fuel ratio-detecting means;

the selecting means correcting the value of sampling timing according to the deterioration parameter;

the cylinder-by-cylinder air-fuel ratio-estimating means including confluent portion air-fuel ratio-estimating means for estimating an air-fuel ratio at the confluent portion of the exhaust system by using the delay parameter, the cylinder-by-cylinder air-fuel ratio-estimating means estimating the air-fuel ratio of the mixture supplied to the each of the cylinders by using an output from the confluent portion air-fuel ratio-estimating means;

the confluent portion air-fuel ratio-estimating means correcting the delay parameter according to the deterioration parameter.

Preferably, the selecting means calculates a correcting amount of the value of sampling timing according to the deterioration parameter and the sampling timing.

Also preferably, the cylinder-by-cylinder air-fuel ratio-estimating system includes inhibiting means for inhibiting the cylinder-by-cylinder air-fuel ratio-estimating means from estimating the air-fuel ratio of the mixture supplied to the each of the cylinders when none of the sampled output values stored by the sampling means correspond to the value of sampling timing corrected according to the deterioration parameter by the selecting means.

The above and other objects, features, and advantages of the invention will become more apparent from the following detailed description taken in conjunction with the accompanying drawings.

BRIEF DESCRIPTION OF THE DRAWINGS

FIGS. 4A and 4B collectively form a timing chart showing the relationship between TDC signal pulses obtained from a multi-cylinder internal combustion engine and the air-fuel ratio detected at a confluent portion of the exhaust system of the engine, in which:

FIG. 4A shows TDC signal pulses obtained from the engine; and

FIG. 4B shows the air-fuel ratio detected at the confluent portion of the exhaust system;

FIG. 5A and FIG. 5B show good and bad examples of timing of sampling an output from the LAF sensor, in which;

FIG. 5A shows examples of the sampling timing in relation to the actual air-fuel ratio; and FIG. 5B shows examples of the air-fuel ratio recognized by an ECU through sampling of the output from the LAF sensor;

DETAILED DESCRIPTION

The invention will now be described in detail with reference to the drawings showing embodiments thereof.

Figure 1:
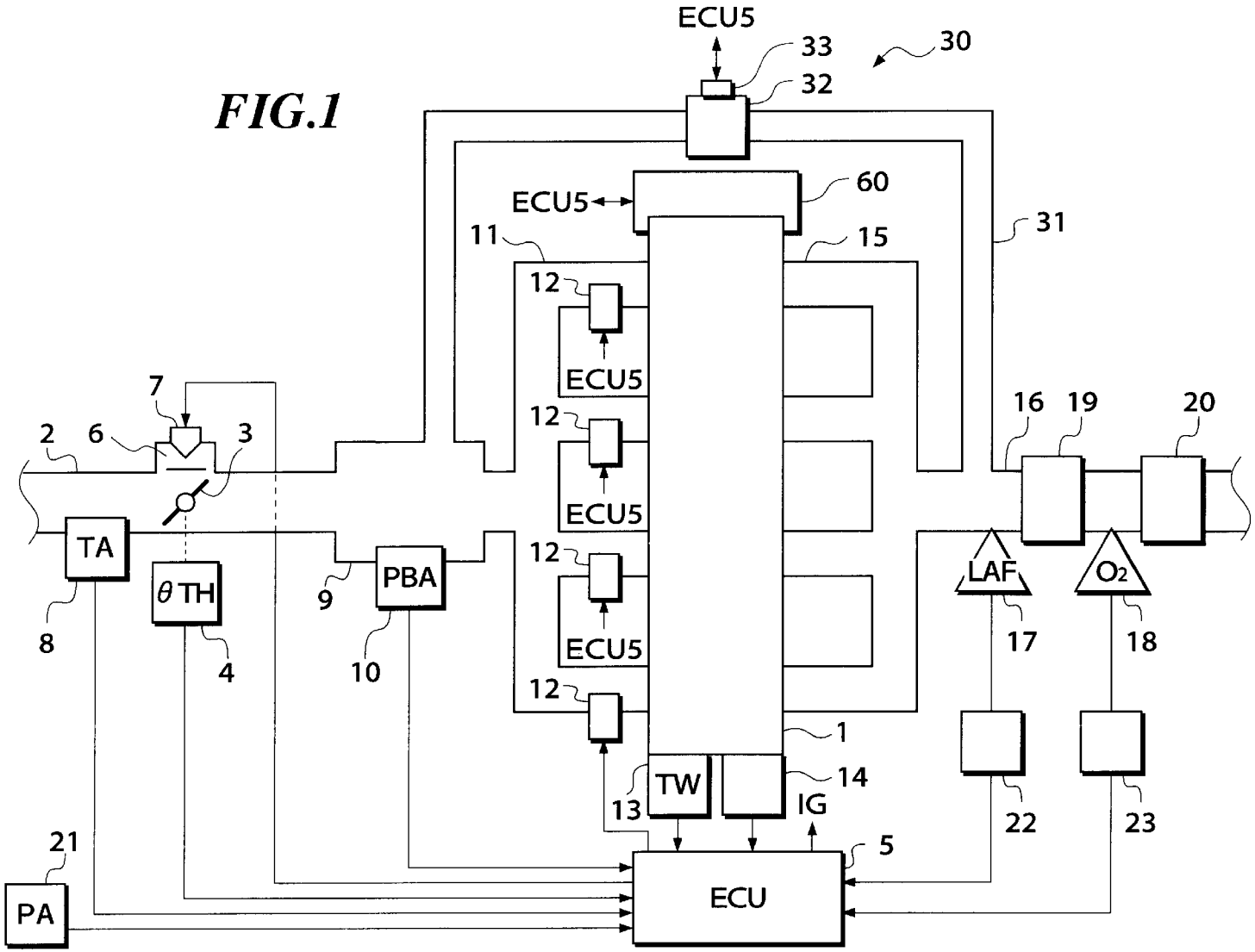
FIG. 1 is a block diagram showing the arrangement of an internal combustion engine incorporating an air-fuel ratio control system therefor, including a cylinder-by-cylinder air-fuel ratio-estimating system according to a first embodiment of the invention.

Referring first to FIG. 1, there is schematically shown the whole arrangement of an internal combustion engine and a control system therefor, including a cylinder-by-cylinder air-fuel ratio-estimating system according to a first embodiment of the invention. In the figure, reference numeral 1 designates a four-cylinder type internal combustion engine (hereinafter simply referred to as "the engine") having a pair of intake valves and a pair of exhaust valves provided for each cylinder, neither of which are shown.

The engine 1 has an intake pipe 2 having a manifold part (intake manifold) 11 directly connected to the combustion chamber of each cylinder. A throttle valve 3 is arranged in the intake pipe 2 at a location upstream of the manifold part 11. A throttle valve opening (θTH) sensor 4 is connected to the throttle valve 3, for generating an electric signal indicative of the sensed throttle valve opening θTH and supplying the same to an electronic control unit (hereinafter referred to as "the ECU") 5. The intake pipe 2 is provided with an auxiliary air passage 6 bypassing the throttle valve 3, and an auxiliary air amount control valve (electromagnetic valve) 7 is arranged across the auxiliary air passage 6. The auxiliary air amount control valve 7 is electrically connected to the ECU 5 to have an amount of opening thereof controlled by a signal therefrom.

An intake air temperature (TA) sensor 8 is inserted into the intake pipe 2 at a location upstream of the throttle valve 3, for supplying an electric signal indicative of the sensed intake air temperature TA to the ECU 5. The intake pipe 2 has a swelled portion 9 as a chamber interposed between the throttle valve 3 and the intake manifold 11. An intake pipe absolute pressure (PBA) sensor 10 is arranged in the chamber 9, for supplying a signal indicative of the sensed intake pipe absolute pressure PBA to the ECU 5.

An engine coolant temperature (TW) sensor 13, which may be formed of a thermistor or the like, is mounted in the cylinder block of the engine 1 filled with an engine coolant, for supplying an electric signal indicative of the sensed engine coolant temperature TW to the ECU 5. A crank angle position sensor 14 for detecting the rotational angle of a crankshaft, not shown, of the engine 1 is electrically connected to the ECU 5 for supplying an electric signal indicative of the sensed rotational angle of the crankshaft to the ECU 5.

The crank angle position sensor 14 is comprised of a cylinder-discriminating sensor, a TDC sensor, and a CRK sensor. The cylinder-discriminating sensor generates a signal pulse (hereinafter referred to as "a CYL signal pulse") at a predetermined crank angle of a particular cylinder of the engine 1, the TDC sensor generates a signal pulse at each of predetermined crank angles (e.g. whenever the crankshaft rotates through 180 degrees when the engine is of the 4-cylinder type) which each correspond to a predetermined crank angle before a top dead point (TDC) of each cylinder corresponding to the start of the suction stroke of the cylinder, and the CRK sensor generates a signal pulse at each of predetermined crank angles (e.g. whenever the crankshaft rotates through 30 degrees) with a predetermined repetition period shorter than the repetition period of TDC signal pulses. The CYL signal pulse, TDC signal pulse, and CRK signal pulse are supplied to the ECU 5, which are used for controlling various kinds of timing, such as a fuel injection timing and an ignition timing, and for detecting the engine rotational speed NE.

Fuel injection valves 12 are inserted into the intake manifold 11 for respective cylinders at locations slightly upstream of the intake valves. The fuel injection valves 12 are connected to a fuel pump, not shown, and electrically connected to the ECU 5 to have the fuel injection timing and fuel injection periods (valve opening periods) thereof controlled by signals therefrom. Spark plugs, not shown, of the engine 1 are also electrically connected to the ECU 5 to have the ignition timing θIG thereof controlled by signals therefrom.

An exhaust pipe 16 of the engine has a manifold part (exhaust manifold) 15 directly connected to the combustion chambers of the cylinders of the engine 1. A linear output oxygen concentration sensor (hereinafter referred to as "the LAF sensor") 17 is arranged in a confluent portion of the exhaust pipe 16 at a location immediately downstream of the exhaust manifold 15. In the present embodiment, the engine is of the 4-cylinder type and includes the single LAF sensor 17, which, however, is not limitative. When a V-type internal combustion engine is employed, the LAF sensor may be provided for each of the confluent portions of banks in the exhaust system. Further, a first three-way catalyst (immediate downstream three-way catalyst) 19 and a second three-way catalyst (bed-downstream three-way catalyst) 20 are arranged in the confluent portion of the exhaust pipe 16 at locations downstream of the LAF sensor 17, for purifying noxious components present in exhaust gases, such as HC, CO, and NOx. An oxygen concentration sensor (hereinafter referred to as "the O2 sensor") 18 is inserted into the exhaust pipe 16 at a location intermediate between the three-way catalysts 19 and 20.

The LAF sensor 17 is electrically connected via a low-pass filter 22 to the ECU 5, for supplying the ECU 5 with an electric signal substantially proportional in value to the concentration of oxygen present in exhaust gases from the engine (i.e. the air-fuel ratio). The O2 sensor 18 has an output characteristic that output voltage thereof drastically changes when the air-fuel ratio of a mixture supplied to the engine changes across a stoichiometric air-fuel ratio to deliver a high level signal when the mixture is richer than the stoichiometric air-fuel ratio, and a low level signal when the mixture is leaner than the same. The O2 sensor 18 is electrically connected via a low-pass filter 23 to the ECU 5 for supplying the ECU 5 with the high or low level signal.

The engine 1 is provided with an exhaust gas recirculation (EGR) system 30 which is comprised of an exhaust gas recirculation passage 31 extending between the chamber 9 of the intake pipe 2 and the exhaust pipe 16, an exhaust gas recirculation control valve (hereinafter referred to as "the EGR valve") 32 arranged across the exhaust gas recirculation passage 31, for controlling the amount of exhaust gases to be recirculated, and a lift sensor 33 for detecting the lift of the EGR valve 32 and supplying a signal indicative of the detected valve lift to the ECU 5. The EGR valve 32 is an electromagnetic valve having a solenoid which is electrically connected to the ECU 5, the valve lift of which is linearly changed by a control signal from the ECU 5.

The engine 1 includes a valve timing changeover mechanism 60 which changes valve timing of the intake valves and exhaust valves between a high speed valve timing suitable for a high speed operating region of the engine and a low speed valve timing suitable for a low speed operating region of the same. The changeover of the valve timing includes not only timing of opening and closing of the valve but also changeover of the valve lift amount, and further, when the low speed valve timing is selected, one of the two intake valves is disabled, thereby ensuring stable combustion even when the air-fuel ratio of the mixture is controlled to a leaner value than the stoichiometric air-fuel ratio.

The valve timing changeover mechanism 60 changes the valve timing by means of hydraulic pressure, and an electromagnetic valve for changing the hydraulic pressure and a hydraulic pressure sensor, neither of which is shown, are electrically connected to the ECU 5. A signal indicative of the sensed hydraulic pressure is supplied to the ECU 5 which in turn controls the electromagnetic valve for changing the valve timing.

Further electrically connected to the ECU 5 is an atmospheric pressure (PA) sensor 21, for detecting atmospheric pressure PA, and supplying a signal indicative of the sensed atmospheric pressure PA to the ECU 5.

The ECU 5 is comprised of an input circuit having the functions of shaping the waveforms of input signals from various sensors mentioned above, shifting the voltage levels of sensor output signals to a predetermined level, converting analog signals from analog-output sensors to digital signals, and so forth, a central processing unit (hereinafter referred to as "the CPU"), a memory circuit comprised of a ROM storing various operational programs which are executed by the CPU and various maps, referred to hereinafter, and a RAM for storing results of calculations from the CPU, etc., and an output circuit which outputs driving signals to the fuel injection valves 12 and other electromagnetic valves, the spark plugs, etc.

The ECU 5 operates in response to the above-mentioned signals from the sensors to determine operating conditions in which the engine 1 is operating, such as an air-fuel ratio feedback control region in which air-fuel ratio feedback control is carried out in response to outputs from the LAF sensor 17 and the O2 sensor 18, and air-fuel ratio open-loop control regions, and calculates, based upon the determined engine operating conditions, the fuel injection period TOUT over which the fuel injection valves 12 are to be opened, by the use of the following equation (1), to output signals for driving the fuel injection valves 12, based on the results of the calculation:

$$TOUT(N)=TIMF\times KTOTAL\times KCMDM\times KLAF\times KOBSV\#N \quad (1)$$

where TIMF represents a basic value of the fuel injection amount TOUT(N), KTOTAL a correction coefficient, KCMDM a final desired air-fuel ratio coefficient, KLAF a PID correction coefficient, and KOBSV#N a cylinder-by-cylinder correction coefficient, respectively.

Figure 2:
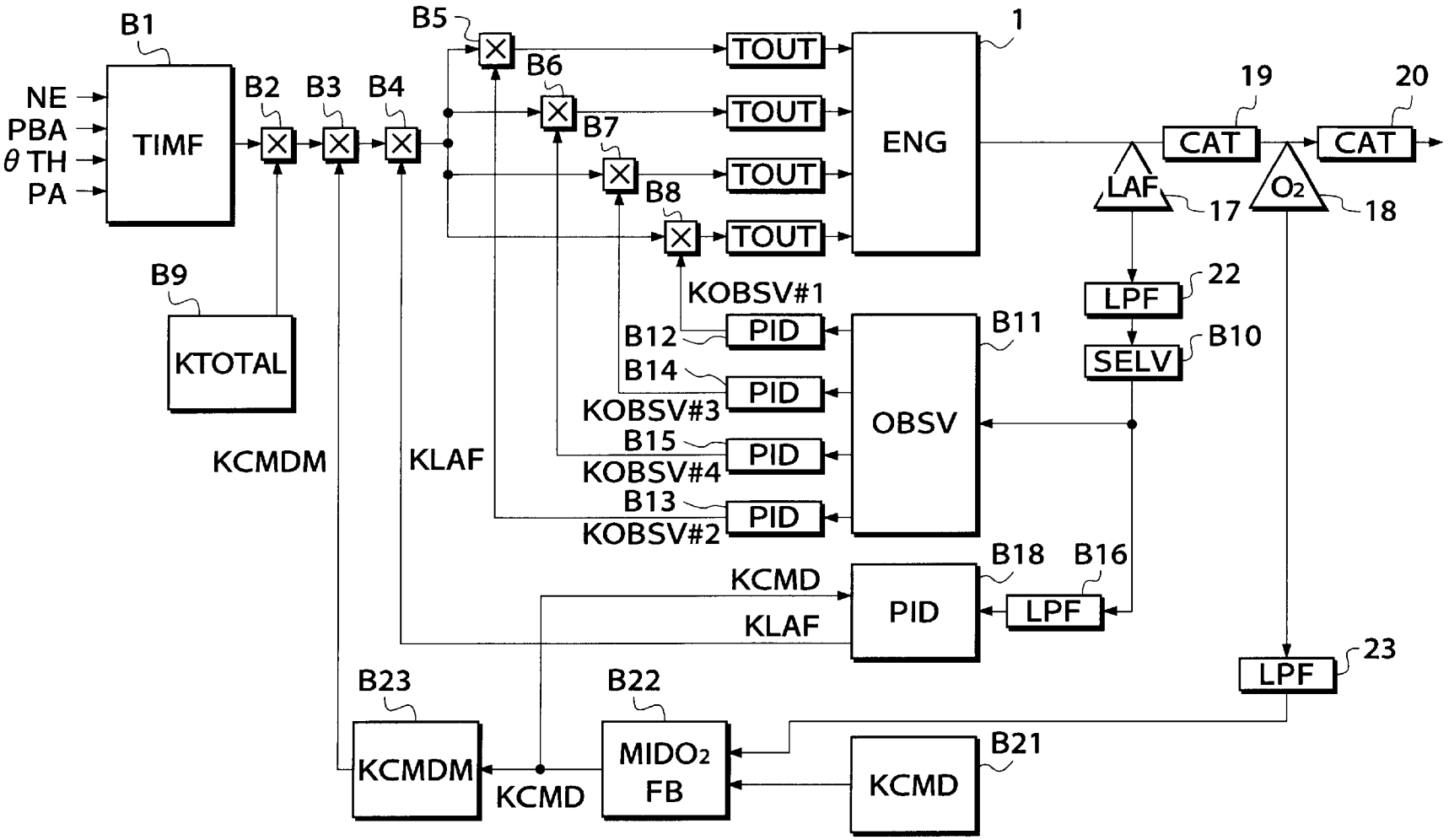
FIG. 2 is a block diagram useful in explaining a manner of controlling the air-fuel ratio of a mixture supplied to the engine.

FIG. 2 is a block diagram useful in explaining a manner of calculating the fuel injection period TOUT(N) by the use of the equation (1). With reference to the figure, an outline of the manner of calculating the fuel injection period TOUT (N) according to the present embodiment will be described. The suffix (N) represents a cylinder number, and a parameter with this suffix is calculated cylinder by cylinder. It should be noted that in the present embodiment, the amount of fuel to be supplied to the engine is calculated, actually, in terms of a time period over which the fuel injection valve 6 is opened (fuel injection period), but in the present specification, the fuel injection period TOUT is referred to as the fuel injection amount or the fuel amount since the fuel injection period is equivalent to the amount of fuel injected or to be injected.

In FIG. 2, a block B1 calculates the basic fuel amount TIMF corresponding to an amount of intake air. The basic fuel amount TIMF is basically set according to the engine rotational speed NE and the intake pipe absolute pressure PBA. However, it is preferred that a model representative of a part of the intake system extending from the throttle valve 3 to the combustion chambers of the engine 1 is prepared in advance, and a correction is made to the basic fuel amount TIMF in dependence on a delay of the flow of intake air obtained based on the model. In this preferred method, the throttle valve opening θTH and the atmospheric pressure PA are also used as additional parameters indicative of operating conditions of the engine.

Reference numerals B2 to B8 designate multiplying blocks, which multiply the basic fuel amount TIMF by respective parameter values input thereto, and deliver the product values. These blocks carry out the arithmetic operation of the equation (1), and outputs from the multiplying blocks B5 to B8 provide fuel injection amounts TOUT(N) for the respective cylinders.

A block B9 multiplies together all feedforward correction coefficients, such as an engine coolant temperature-dependent correction coefficient KTW set according to the engine coolant temperature TW and an EGR-dependent correction coefficient KEGR set according to the amount of recirculation of exhaust gases during execution of the exhaust gas recirculation, to obtain the correction coefficient KTOTAL, which is supplied to the block B2.

A block B21 determines a desired air-fuel ratio coefficient KCMD based on the engine rotational speed NE, the intake pipe absolute pressure PBA, etc., and supplies the same to a block B22. The desired air-fuel ratio coefficient KCMD is directly proportional to the reciprocal of the air-fuel ratio A/F, i.e. the fuel-air ratio F/A, and assumes a value of 1.0 when it is equivalent to the stoichiometric air-fuel ratio. For this reason, this coefficient KCMD will be also referred to as the desired equivalent ratio. The block B22 corrects the desired air-fuel ratio coefficient KCMD based on the output VMO2 from the O2 sensor 18 supplied via the low-pass filter 23, and delivers the corrected KCMD value to blocks B18 and B23. The block B23 carries out fuel cooling-dependent correction of the corrected KCMD value to calculate the final desired air-fuel ratio coefficient KCMDM and supplies the same to the block B3.

A block B10 samples the output from the LAF sensor 17 supplied via the low-pass filter 22 with a sampling period in synchronism with generation of each CRK signal pulse, sequentially stores the sampled values in a ring buffer memory, not shown, and selects one of the stored values depending on operating conditions of the engine (LAF sensor output-selecting process), which was sampled at the optimum timing for each cylinder, to supply the selected value to a block B11 and the block B18 via a low-pass filter block B16. The LAF sensor output-selecting process eliminates the inconveniences that the air-fuel ratio, which changes every moment, cannot be accurately detected depending on the timing of sampling of the output from the LAF sensor 17, there is a time lag before exhaust gases emitted from the combustion chamber reach the LAF sensor 17, and the response time of the LAF sensor per se changes depending on operating conditions of the engine.

The block B18 calculates the PID correction coefficient KLAF through PID control, based on the difference between the actual air-fuel ratio and the desired air-fuel ratio and supplies the KLAF value to the block B4.

The block B11 has the function of a so-called observer, i.e. a function of estimating a value of the air-fuel ratio separately for each cylinder from the air-fuel ratio (of a mixture of exhaust gases emitted from the cylinders) detected at the confluent portion of the exhaust system by the LAF sensor 17, and supplying the estimated value to a corresponding one of blocks B12 to B15 associated, respectively, with the four cylinders. In FIG. 2, the block B12 corresponds to a cylinder #1, the block B13 to a cylinder #2, the block B14 to a cylinder #3, and the block B15 to a cylinder #4. The blocks B12 to B15 calculate the cylinder-by-cylinder correction coefficient KOBSV#N (N=1 to 4) by the PID control such that the air-fuel ratio of each cylinder (the value of the air-fuel ratio estimated by the observer B11 for each cylinder) becomes equal to a value of the air-fuel ratio detected at the confluent portion, and supply KOBSV#N values to the blocks B5 to B8, respectively.

As described above, in the present embodiment, the fuel injection amount TOUT(N) is calculated cylinder by cylinder by applying to the equation (1) the PID correction coefficient KLAF which is calculated by the ordinary PID control according to the output from the LAF sensor 17, as well as applying to the same equation the cylinder-by-cylinder correction coefficient KOBSV#N which is set according to the air-fuel ratio of each cylinder estimated based on the output from the LAF sensor 17. Variations in the air-fuel ratio between the cylinders can be eliminated by the use of the cylinder-by-cylinder correction coefficient KOBSV#N to thereby improve the purifying efficiency of the catalysts and hence obtain good exhaust emission characteristics of the engine in various operating conditions.

In the present embodiment, the functions of the blocks appearing in FIG. 2 are realized by arithmetic operations executed by the CPU of the ECU 5, and details of the operations will be described with reference to program routines illustrated in the drawings.

Figure 3:
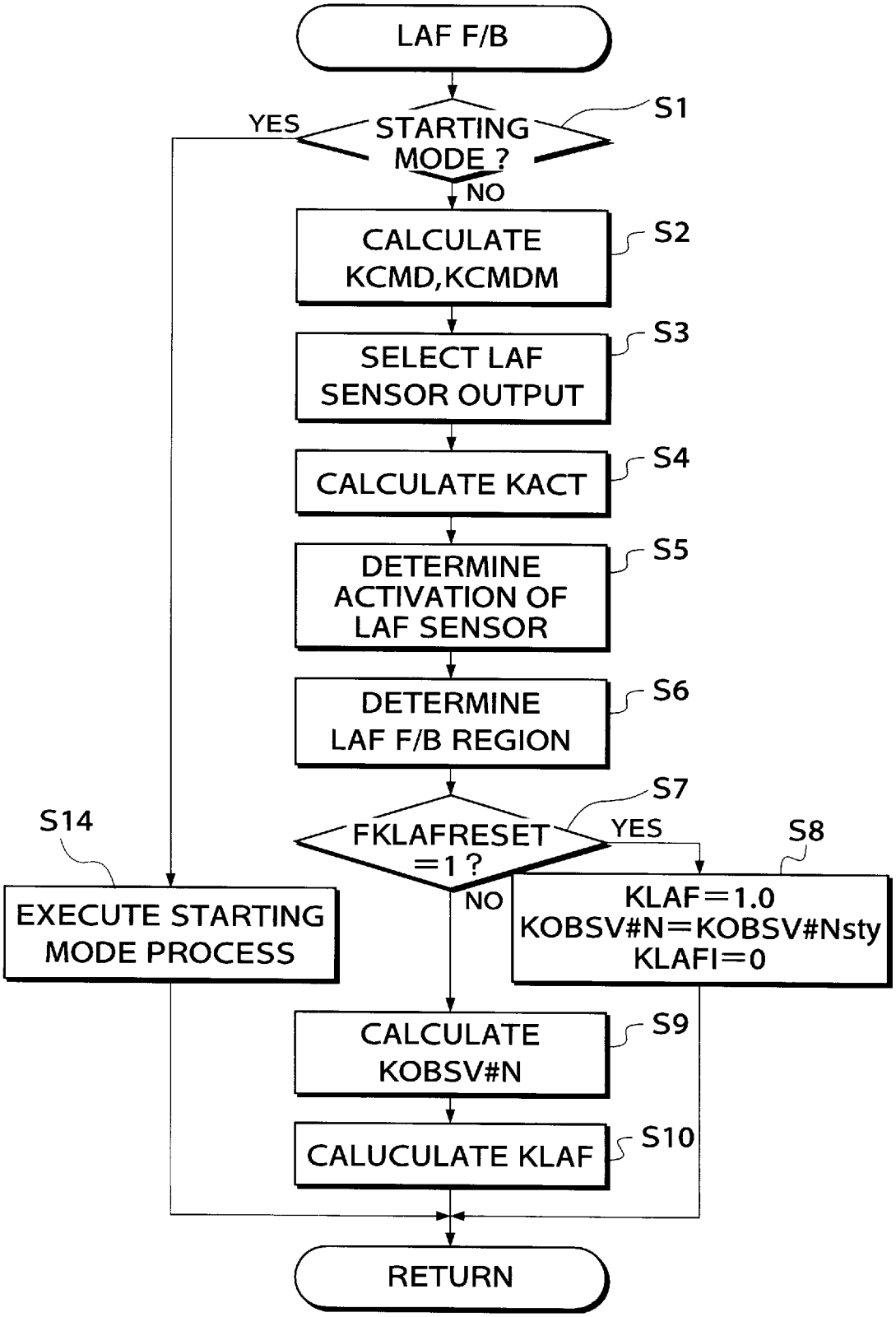
FIG. 3 is a flowchart showing a main routine for calculating a PID correction coefficient KLAF and a cylinder-by-cylinder correction coefficient KOBSV#N in response to an output from a LAF sensor appearing in FIG. 1.

FIG. 3 shows a main routine for calculating the PID correction coefficient KLAF and the cylinder-by-cylinder correction coefficient KOBSV#N according to the output from the LAF sensor 17. This routine is executed in synchronism with generation of TDC signal pulses.

At a step S1, it is determined whether or not the engine is in starting mode, i.e. whether or not the engine is cranking. If the engine is in the starting mode, the program proceeds to a step S14 to execute a subroutine for the starting mode, not shown. If the engine is not in the starting mode, the desired air-fuel ratio coefficient (desired equivalent ratio) KCMD and the final desired air-fuel ratio coefficient KCMDM are calculated depending on the engine operating conditions at a step S2, and the LAF sensor output-selecting process is executed at a step S3. Further, an actual equivalent ratio KACT depending on the output from the LAF sensor is calculated at a step S4. The actual equivalent ratio KACT is obtained by converting the output from the LAF sensor 17 to an equivalent ratio value.

Then, it is determined at a step S5 whether or not the LAF sensor 17 has been activated. This determination is carried out by comparing the difference between the output voltage from the LAF sensor 17 and a central voltage thereof with a predetermined value (e.g. 0.4 V), and determining that the LAF sensor 17 has been activated when the difference is smaller than the predetermined value.

Then, it is determined at a step S6 whether or not the engine 1 is in an operating region in which the air-fuel ratio feedback control responsive to the output from the LAF sensor 17 is to be carried out (hereinafter referred to as "the LAF feedback control region"). More specifically, it is determined that the engine 1 is in the LAF feedback control region, e.g. when the LAF sensor 17 has been activated but at the same time neither fuel cut nor wide open throttle operation is being carried out. If it is determined that the engine is not in the LAF feedback control region, a reset flag FKLAFRESET which, when set to "1", indicates that the engine is not in the LAF feedback control region, is set to "1", whereas if it is determined the engine is in the LAF feedback control region, the reset flag FKLAFRESET is set to "0".

At the following step S7, it is determined whether or not the reset flag FKLAFRESET assumes "1". If FKLAFRSET=1 holds, the program proceeds to a step S8, wherein the PID correction coefficient KLAF is set to "1.0", the cylinder-by-cylinder correction coefficient KOBSV#N is set to a learned value KOBSV#Nsty thereof, referred to hereinafter, and an integral term KLAFI used in the PID control is set to "0", followed by terminating the program. By setting the cylinder-by-cylinder correction coefficient KOBSV#N to the learned value KOBSV#Nsty thereof, it is possible to prevent a misfire of the engine ascribable to changes in the mechanical parts of the fuel supply system due to aging, as well as ensure required stability of the engine operation during the feedforward control against undesired fluctuations in the rotation of the engine.

On the other hand, if FKLAFRESET=0 holds at the step S7, the cylinder-by-cylinder correction coefficient KOBSV#N and the PID correction coefficient KLAF are calculated at respective steps S9 and S10, followed by terminating the present routine.

The PID correction coefficient KLAF is calculated according to the difference between the actual equivalent ratio KACT and the desired air-fuel ratio coefficient (desired equivalent ratio) KCMD in a well-known PID control method.

Next, the LAF sensor output-selecting process executed at the step S3 in FIG. 3 will be described.

Figure 4A:
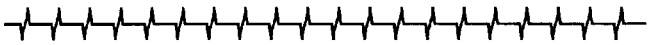
Figure 4B:
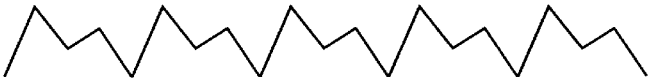
Figures 5A, 5B:
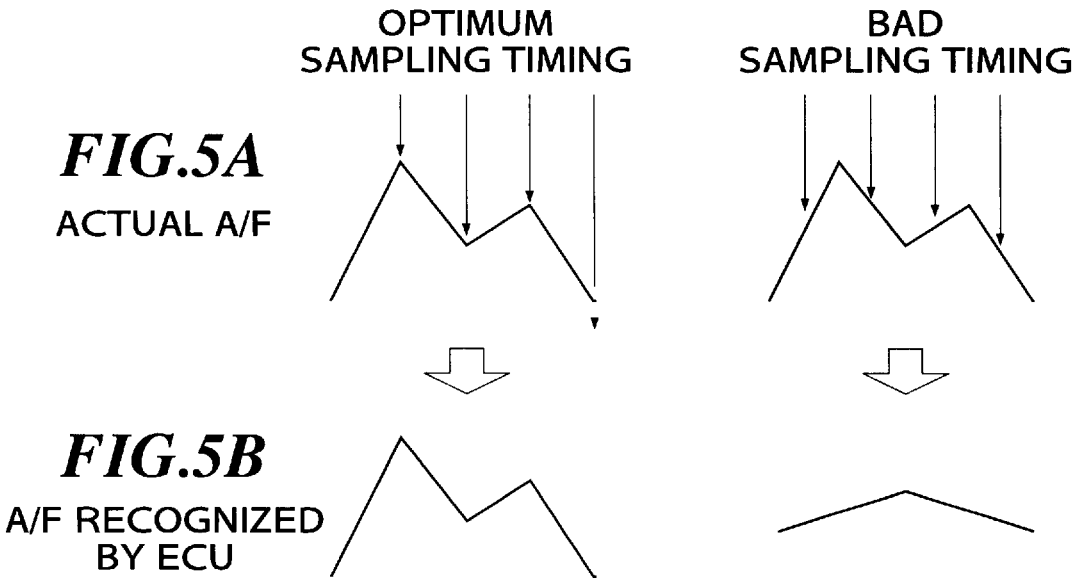

Exhaust gases are emitted from the engine on the exhaust stroke, and accordingly, clearly the behavior of the air-fuel ratio detected at the confluent portion of the exhaust system of the multi-cylinder engine is synchronous with generation of TDC signal pulses. Therefore, detection of the air-fuel ratio by the LAF sensor 17 is also required to be carried out in synchronism with generation of TDC signal pulses. However, depending on the timing of sampling the output from the LAF sensor 17, there are cases where the behavior of the air-fuel ratio cannot be accurately grasped. For example, if the air-fuel ratio detected at the confluent portion of the exhaust system varies as shown in FIG. 4B in comparison with timing of generation of each TDC signal pulse shown in FIG. 4A, the air-fuel ratio recognized by the ECU 5 can have quite different values depending on the timing of sampling, as shown in FIG. 5B. Therefore, it is desirable that the sampling of the output from the LAF sensor 17 should be carried out at such timing as enables the ECU 5 to recognize actual variation in the sensor output as accurately as possible.

Further, the variation in the air-fuel ratio also depends upon a time period required to elapse before exhaust gases emitted from the cylinder reach the LAF sensor 17 as well as upon the response time of the LAF sensor 17. The required time period depends on the pressure and volume of exhaust gases, etc. Further, sampling of the sensor output in synchronism with generation of TDC signal pulses is equivalent to sampling of the same based on the crank angle position, so that the sampling result is inevitably influenced by the engine rotational speed NE. The optimum timing of detection of the air-fuel ratio thus largely depends upon operating conditions of the engine.

Figure 6:
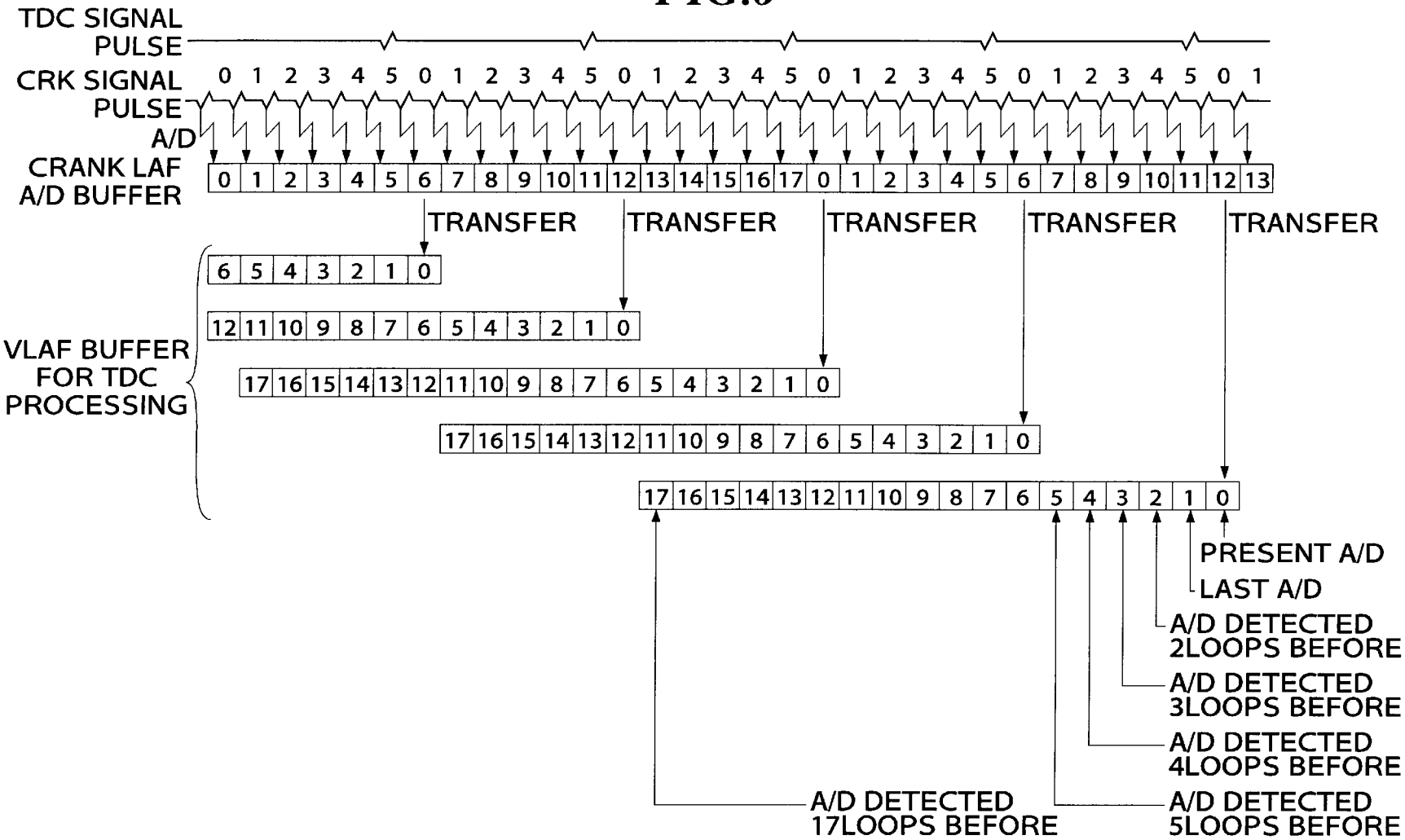
FIG. 6 is a diagram which is useful in explaining how to select a value of the output from the LAF sensor sampled at the optimum timing from values of the same sampled whenever a CRK signal pulse is generated.

In view of the above fact, in the present embodiment, as shown in FIG. 6, values of the output from the LAF sensor 17 sampled in synchronism with generation of CRK signal pulses (at crank angle intervals of 30 degrees) are sequentially stored in the ring buffer memory (having 18 storage locations in the present embodiment), and one sampled at the optimum timing (selected out of the values from a value obtained 17 loops before to the present value) is converted to the actual equivalent ratio KACT for use in the feedback control.

Figure 7:
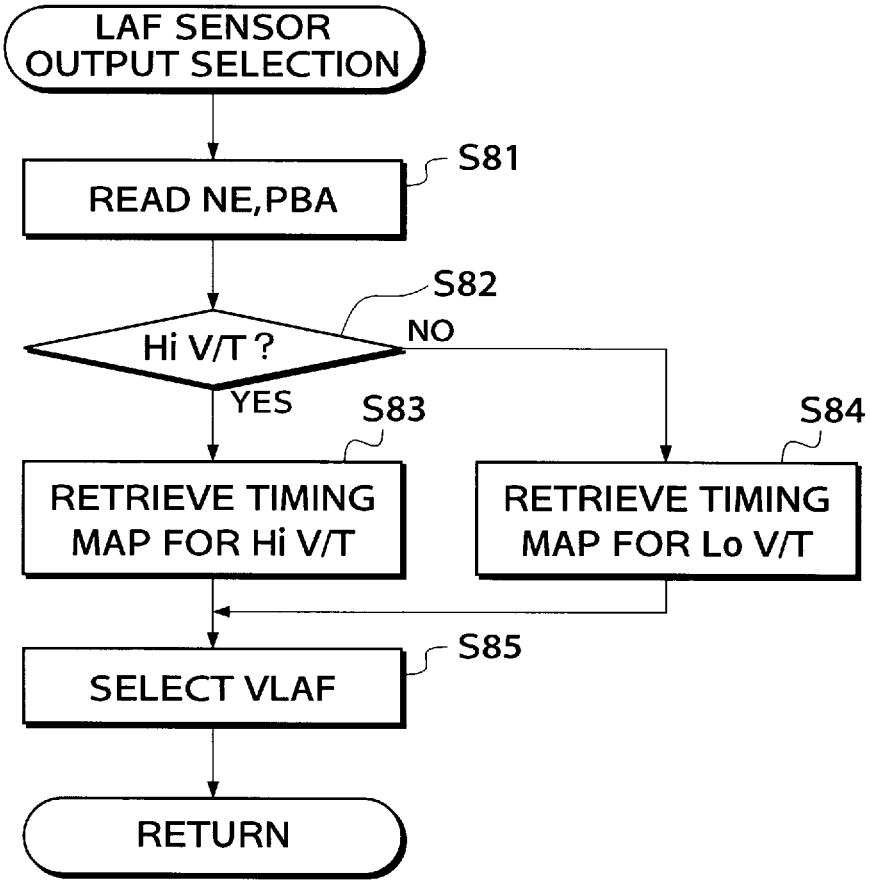
FIG. 7 is a flowchart showing a subroutine for selecting a value of the output from the LAF sensor (LAF sensor output value), which is executed at a step S3 in FIG. 3.

FIG. 7 shows a subroutine for carrying out the LAF sensor output-selecting process, which is executed at the step S3 in FIG. 3.

First, at a step S81, the engine rotational speed NE and the intake pipe absolute pressure PBA are read from the respective sensor outputs, and then it is determined at a step S82 whether or not the present valve timing is set to the high-speed valve timing. If the present valve timing is set to the high-speed valve timing, a timing map suitable for the high-speed valve timing is retrieved at a step S83, whereas if the same is set to the low-speed valve timing, a timing map suitable for the low-speed valve timing is retrieved at a step S84. Then, one of the LAF sensor output values VLAF stored in the ring buffer is selected according to the result of the retrieval at a step S85, followed by terminating the program.

Figure 8:
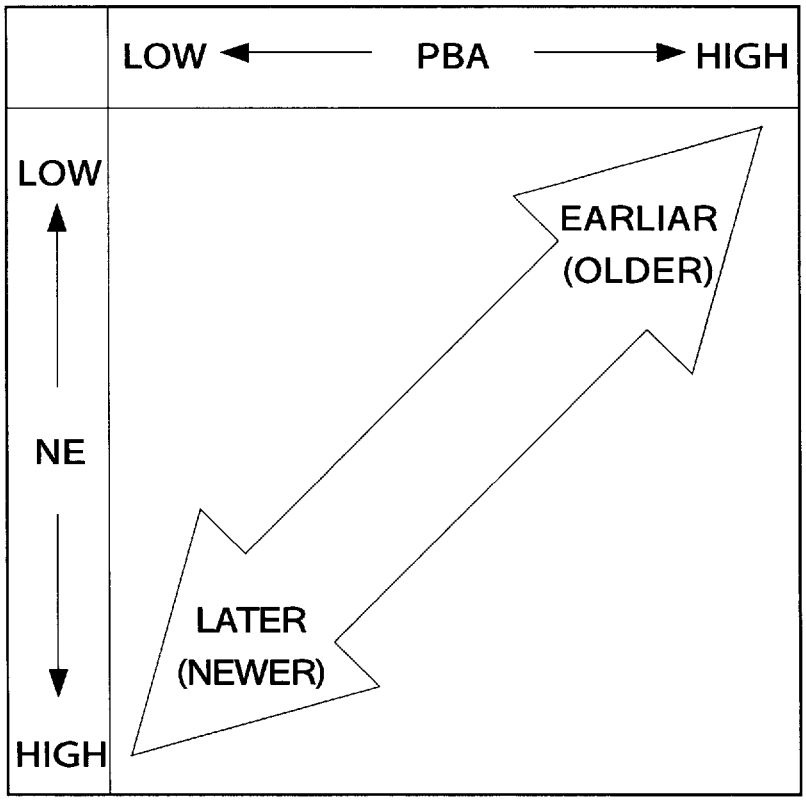
FIG. 8 is a diagram showing characteristics of timing maps used in the FIG. 7 subroutine.
Figure 9A:
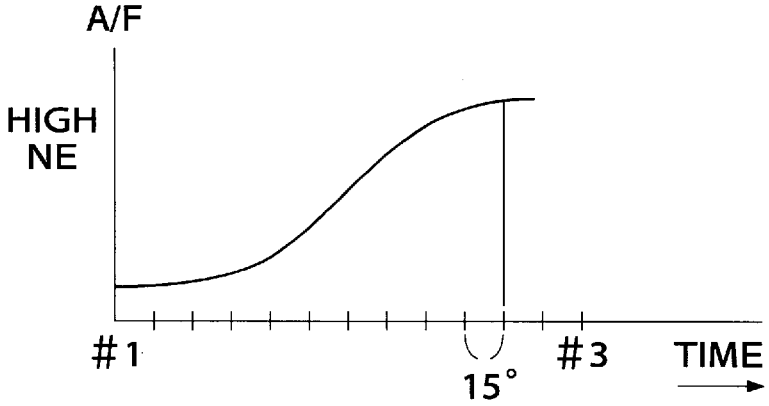
FIG. 9A is a diagram showing characteristics of the output from the LAF sensor assumed at a high engine rotational speed, which is useful in explaining the characteristics of the timing maps shown in FIG. 8.
Figure 9B:
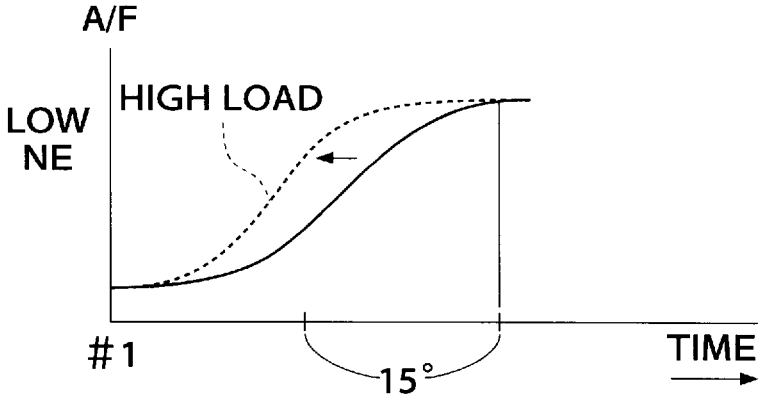
FIG. 9B is a diagram showing characteristics of the output from the LAF sensor assumed at a low engine rotational speed with a shift to be effected when a change in load on the engine occurs, which is useful in explaining the characteristics of the timing maps shown in FIG. 8.

The timing maps are set e.g. as shown in FIG. 8 such that as the engine rotational speed NE is lower and/or the intake pipe absolute pressure PBA is higher, a value sampled at an earlier crank angle position is selected. The word "earlier" in this case means "closer to the immediately preceding TDC position of the cylinder" (in other words, an "older" sampled value is selected). The setting of these maps is based on the fact that, as shown in FIGS. 5A and 5B referred to before, the air-fuel ratio is best sampled at timing closest to time points corresponding to maximal and minimal values (hereinafter both referred to as "extreme values" of the actual air-fuel ratio), and assuming that the response time (delay of response) of the LAF sensor 17 is constant, an extreme value, e.g. a first peak value, occurs at an earlier crank angle position as the engine rotational speed NE is lower, and the pressure and volume of exhaust gases emitted from the cylinders increase with increase in the load on the engine, so that the exhaust gases reach the LAF sensor 17 in a shorter time period, as shown in FIG. 9A and 9B.

As described above, according to the FIG. 7 process, the sensor output VLAF value sampled at the optimum timing is selected depending on operating conditions of the engine, which improves the accuracy of detection of the air-fuel ratio. As a result, a cylinder-by-cylinder value of the air-fuel ratio can be estimated by the observer with enhanced accuracy, leading to improved accuracy of the air-fuel ratio feedback control for each cylinder.

In view of expected variations in response time between mass-produced LAF sensors employed, each LAF sensor to be employed may be measured in response time and sorted into m ranks according to the measured response time beforehand, and the sensor output VLAF read from the timing map may be corrected by one of a plurality (m) of values of a correction term selected according to the sorted rank to which the LAF sensor belongs. Alternatively, a plurality (m) of timing maps may be provided for each valve timing, and m jumper wires may be provided on the substrate of the ECU beforehand, which correspond, respectively, to the timing maps, so that one of the jumper wires is selected depending on the response characteristic of the LAF sensor to be associated with the ECU, to thereby select one of the timing maps optimal to the response time of the LAF sensor.

Next, description will be made of the manner of calculation of the cylinder-by-cylinder correction coefficient KOBSV#N executed at the step S9 in FIG. 3.

In the following description, first, a manner of estimating the cylinder-by-cylinder air-fuel ratio by the observer will be described, and then a manner of calculating the cylinder-by-cylinder correction coefficient KOBSV#N according to the estimated cylinder-by-cylinder air-fuel ratio will be described.

The air-fuel ratio detected at the confluent portion of the exhaust system is regarded as a weighted average value of air-fuel ratio values of the cylinders, which reflects time-dependent contributions of all the cylinders, whereby values of the air-fuel ratio detected at time points (k), (k+1), and (k+2) are expressed by equations (2A), (2B), and (2C), respectively. In preparing these equations, the fuel amount (F) was used as an operation amount, and accordingly the fuel-air ratio F/A is used in these equations:

$$[F/A](k) = C_1[F/A\#1] + C_2[F/A\#3] + C_3[F/A\#4] + C_4[F/A\#2] \tag{2A}$$

$$[F/A](k+1) = C_1[F/A\#3] + C_2[F/A\#4] + C_3[F/A\#2] + C_4[F/A\#1] \tag{2B}$$

$$[F/A](k+2) = C_1[F/A\#4] + C_2[F/A\#2] + C_3[F/A\#1] + C_4[F/A\#3] \tag{2C}$$

Figure 10:
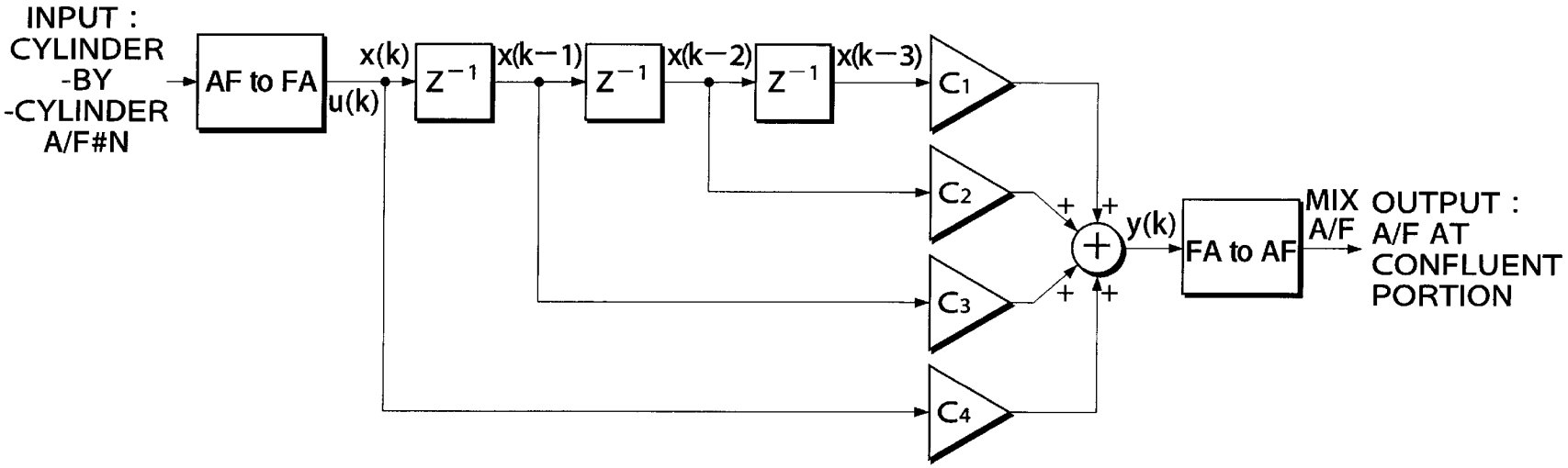
FIG. 10 is a block diagram showing a model representative of the behavior of the exhaust system of the engine.

More specifically, the fuel-air ratio detected at the confluent portion of the exhaust system is expressed as the sum of values of the cylinder-by-cylinder fuel-air ratio multiplied by respective weights C varying in the order of combustion (e.g. 40% for a cylinder corresponding to the immediately preceding combustion, 30% for one corresponding to the second preceding combustion, and so on). This model can be expressed in a block diagram as shown in FIG. 10, and the state equation therefor is expressed by the following equation (3):

$$\begin{bmatrix} x(k-2) \\ x(k-1) \\ x(k) \end{bmatrix} = \begin{bmatrix} 010 \\ 001 \\ 000 \end{bmatrix} \begin{bmatrix} x(k-3) \\ x(k-2) \\ x(k-1) \end{bmatrix} + \begin{bmatrix} 0 \\ 0 \\ 1 \end{bmatrix} u(k) \tag{3}$$

Further, if the fuel-air ratio detected at the confluent portion is designated by y(k), the output equation can be expressed by the following equation (4):

$$y(k) = [c_1 c_2 c_3] \begin{bmatrix} x(k-3) \\ x(k-2) \\ x(k-1) \end{bmatrix} + c_4\, u(k) \tag{4}$$

where, $c_1$: 0.05, $c_2$: 0.15, $c_3$: 0.30, $c_4$: 0.50.

In the equation (4), u(k) cannot be observed, and hence an observer designed based on this state equation cannot per-form observation of x(k). Therefore, on the assumption that a value of the air-fuel ratio detected four TDC signal pulses earlier (i.e. the immediately preceding value for the same cylinder) represents a value obtained under a steady operating condition of the engine without any drastic change in the air-fuel ratio, it is regarded that x(k+1)=x(k−3), whereby the equation (4) can be changed into the following equation (5):

$$\begin{bmatrix} x(k-2) \\ x(k-1) \\ x(k) \\ x(k+1) \end{bmatrix} = \begin{bmatrix} 0100 \\ 0010 \\ 0001 \\ 1000 \end{bmatrix} \begin{bmatrix} x(k-3) \\ x(k-2) \\ x(k-1) \\ x(k) \end{bmatrix} \tag{5}$$

$$y(k) = [c_1 c_2 c_3 c_4] \begin{bmatrix} x(k-3) \\ x(k-2) \\ x(k-1) \\ x(k) \end{bmatrix}$$

It has been empirically ascertained that the thus set model well represents the exhaust system of a four-cylinder type engine. Therefore, a problem arising from estimating the cylinder-by-cylinder air-fuel ratio from the air-fuel ratio A/F at the confluent portion of the exhaust system is the same as a problem with an ordinary Kalman filter used in observing x(k) by the following state equation and output equation (6). If weight matrices Q, R are expressed by the following equation (7), the Riccati's equation can be solved to obtain a gain matrix K represented by the following equation (8):

$$X(k+1)=AX(k)+Bu(k)\ y(k)=CX(k)+Du(k) \tag{6}$$

where $$A = \begin{bmatrix} 0100 \\ 0010 \\ 0001 \\ 1000 \end{bmatrix} C = [c_1 c_2 c_3 c_4] B = D = [0] \tag{7}$$

$$X(k) = \begin{bmatrix} x(k-3) \\ x(k-2) \\ x(k-1) \\ x(k) \end{bmatrix}$$

$$Q = \begin{bmatrix} 1000 \\ 0100 \\ 0010 \\ 0001 \end{bmatrix} R = [1]$$

$$K = \begin{bmatrix} -0.3093 \\ 1.1916 \\ 0.3093 \\ 0.0803 \end{bmatrix} \tag{8}$$

Figure 11:
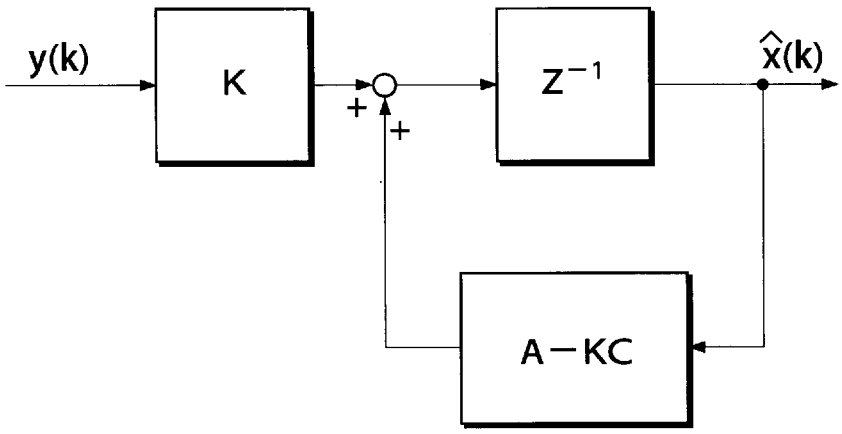
FIG. 11 is a block diagram showing the construction of an observer, which is applied to the model of the exhaust system.

In the model of the present embodiment, there is no inputting of u(k) which is input to an observer of a general type, so that the observer of the present embodiment is constructed such that y(k) alone is input thereto as shown in FIG. 11, which is expressed by the following equation (9):

$$\begin{aligned} \hat{X}(k+1) &= [A - KC]\hat{X}(k) + Ky(k) \\ &= A\hat{X}(k) + K(y(k) - C\hat{X}(k)) \end{aligned} \tag{9}$$

-continued $$\hat{x}(k) = \begin{bmatrix} \hat{x}(k-3) \\ \hat{x}(k-2) \\ \hat{x}(k-1) \\ \hat{x}(k) \end{bmatrix}$$

Therefore, from the fuel-air ratio y(k) at the confluent portion and the estimated value XΛ(k) of the cylinder-by-cylinder fuel-air ratio obtained in the past, the estimated value XΛ(k+1) of the same in the present loop can be calculated.

When the above equation (9) is employed to calculate the cylinder-by-cylinder fuel-air ratio XΛ (k+1), the actual equivalent ratio KACT(k) is substituted for the fuel-air ratio y(k) at the confluent portion. However, the actual equivalent ratio KACT(k) contains the response delay of the LAF sensor 17, whereas the CXΛ(k) value (weighted sum of four cylinder-by-cylinder fuel-air ratio values) does not contain the response delay. Therefore, the cylinder-by-cylinder fuel-air ratio cannot be accurately estimated by the use of the equation (9), due to the influence of the response delay of the LAF sensor 17. Especially, at a high engine rotational speed NE when time intervals at which TDC signal pulses are generated are shorter, the influence of the response delay upon the accuracy of the estimation is large.

According to the present embodiment, therefore, an estimated value yΛ(k) of the fuel-air ratio at the confluent portion is calculated by the use of the following equation (10), and the thus calculated value y Λ(k) is applied to the following equation (11), to thereby calculate the estimated value XΛ(k+1) of the cylinder-by-cylinder air-fuel ratio:

$$\hat{y}(k)=DL\hat{y}(k-1)+(1-DL)C\hat{X}(k) \tag{10}$$

$$\hat{X}(k+1)=A\hat{X}(k)+K(y(k)-\hat{y}(k)) \tag{11}$$

Figure 12:
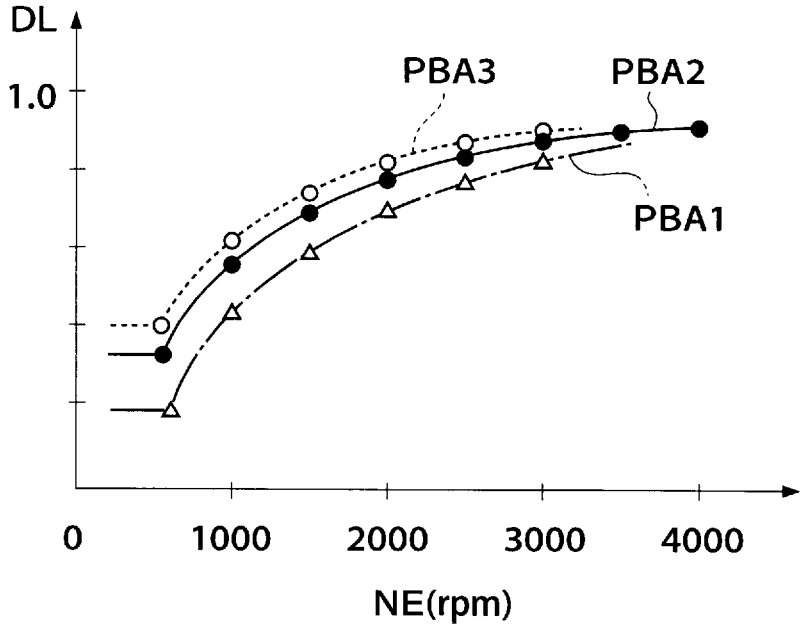
FIG. 12 shows a table for determining a response delay time constant DL for the LAF sensor.

In the above equation (10), DL represents a parameter corresponding to a time constant of the response delay of the LAF sensor 17, which is determined from a DL table shown in FIG. 12. The DL table is set such that the DL value is set to a value between 0 to 1.0 according to the engine rotational speed NE and the intake pipe absolute pressure PBA. In the figure, PBA1 to PBA3 represent 660 mmHg, 460 mmHg, and 260 mmHg, respectively and an interpolation is carried out when the NE and/or PBA value falls between the predetermined values. It has been empirically ascertained that the best compensation for the response delay of the LAF sensor 17 can be obtained if the time constant DL is set to a value corresponding to a time period longer than the actual response delay by approximately 20%.

In the above equations (10) and (11), an initial vector of the XΛ(k) value is set such that component elements thereof (xΛ(k−3), xΛ(k−2), xΛ(k−1)) all assume 1.0, and in the equation (10), an initial value of the estimated value yΛ(k−1) is set to 1.0.

By thus using the equation (11) which is obtained by replacing the CXΛ(k) in the equation (9) by the estimated value yΛ(k) of the fuel-air ratio at the confluent portion containing the response delay, the response delay of the LAF sensor can be properly compensated for, to thereby carry out accurate estimation of the cylinder-by-cylinder air-fuel ratio. Especially, the estimation by the cylinder-by-cylinder air-fuel ratio-estimating system of the present embodiment is less susceptible to the influence of noises compared with the estimation by the conventional system. In the following description, estimated equivalent ratio values KACT#1(k) to KACT#4(k) for the respective cylinders correspond to the xΛ(k) value.

Figure 13:
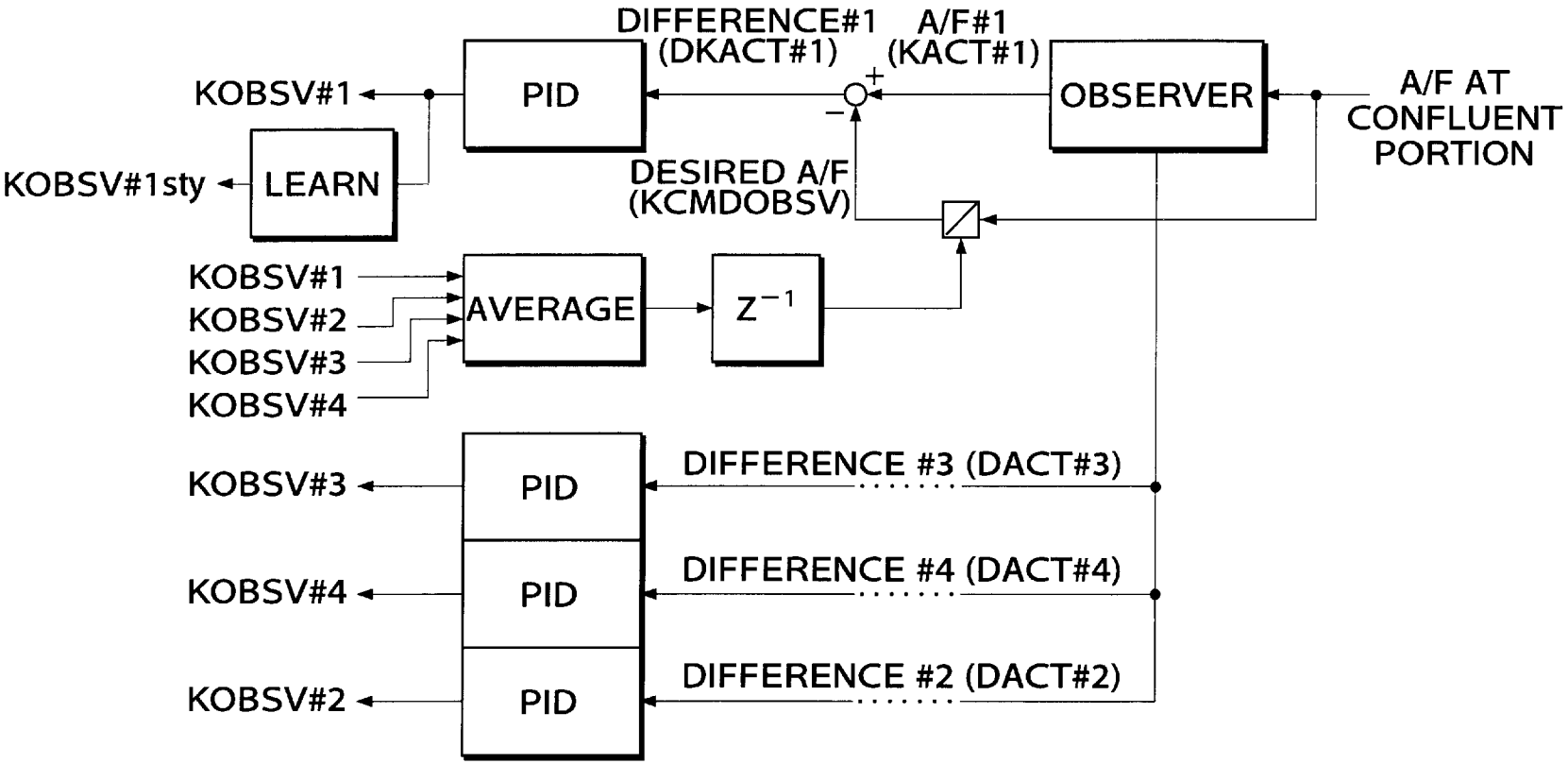
FIG. 13 is a diagram which is useful in explaining a manner of cylinder-by-cylinder air-fuel ratio feedback control.

Next, description will be made of the manner of calculating the cylinder-by-cylinder correction coefficient KOBSV#N, based on the thus estimated cylinder-by-cylinder air-fuel ratio, with reference to FIG. 13.

As shown in the following equation (12), the actual equivalent ratio KACT corresponding to the air-fuel ratio A/F at the confluent portion is divided by the immediately preceding value of an average value of the cylinder-by-cylinder correction coefficient KOBSV#N for all the cylinders, to thereby calculate a desired value KCMDOBSV (k) as an equivalent ratio corresponding to the desired air-fuel ratio. The cylinder-by-cylinder correction coefficient KOBSV#1 for the #1 cylinder is calculated by the PID control such that the difference DKACT#1(k) (=KACT#1 (k)−KCMDOBSV(k)) between the desired value KCMDOBSV(k) and the estimated equivalent ratio KACT#1(k) for the #1 cylinder becomes equal to zero:

$$KCMDOBSV(k) = KACT(k)/\left(\sum_{N=1}^{4} KOBSV\#N(k-1)/4\right) \quad (12)$$

More specifically, a proportional term KOBSVP#1, an integral term KOBSVI#1, and a differential term KOBSVD#1 for use in the PID control are calculated by the use of the respective following equations (13A), (13B), and (13C), to thereby calculate the cylinder-by-cylinder correction coefficient KOBSV#1 by the use of the following equation (14):

$$KOBSVP\#1(k)=KPOBSV\times DKACT\#1(K) \quad (13A)$$

$$KOBSVI\#1(k)=KIOBSV\times DKACT\#1(K)+KOBSVI\#1(k-1) \quad (13B)$$

$$KOBSVD\#1(k)=KDOBSV\times(DKACT\#1(K)-DKACT\#1(k-1)) \quad (13C)$$

$$KOBSV\#1(k)=KOBSVP\#1(k)+KOBSVI\#1(k)+KOBSVD\#1(k)+1.0 \quad (14)$$

where KPOBSV, KIOBSV and KDOBSV represent a basic proportional term, a basic integral term, and a basic differential term, respectively.

The same calculations are carried out with respect to the cylinders #2 to #4, to obtain the cylinder-by-cylinder correction coefficients KOBSV#2 to KOBSV#4 therefor.

By this control operation, the air-fuel ratio of the mixture supplied to each cylinder is converged to the air-fuel ratio detected at the confluent portion of the exhaust system. Since the air-fuel ratio at the confluent portion is converged to the desired air-fuel ratio by the use of the PID correction coefficient KLAF, the air-fuel ratio values of mixtures supplied to all the cylinders can be eventually converged to the desired-air fuel ratio.

Further, a learned value KOBSV#Nsty of the cylinder-by-cylinder correction coefficient KOBSV#N is calculated by the use of the following equation (15) and stored:

$$KOBSV\#Nsty=Csty\times KOBSV\#N+(1-Csty)\times KOBSV\#Nsty \quad (15)$$

where Csty represents a weighting coefficient, and KOBSV#Nsty on the right side the immediately preceding learned value.

Figure 14:
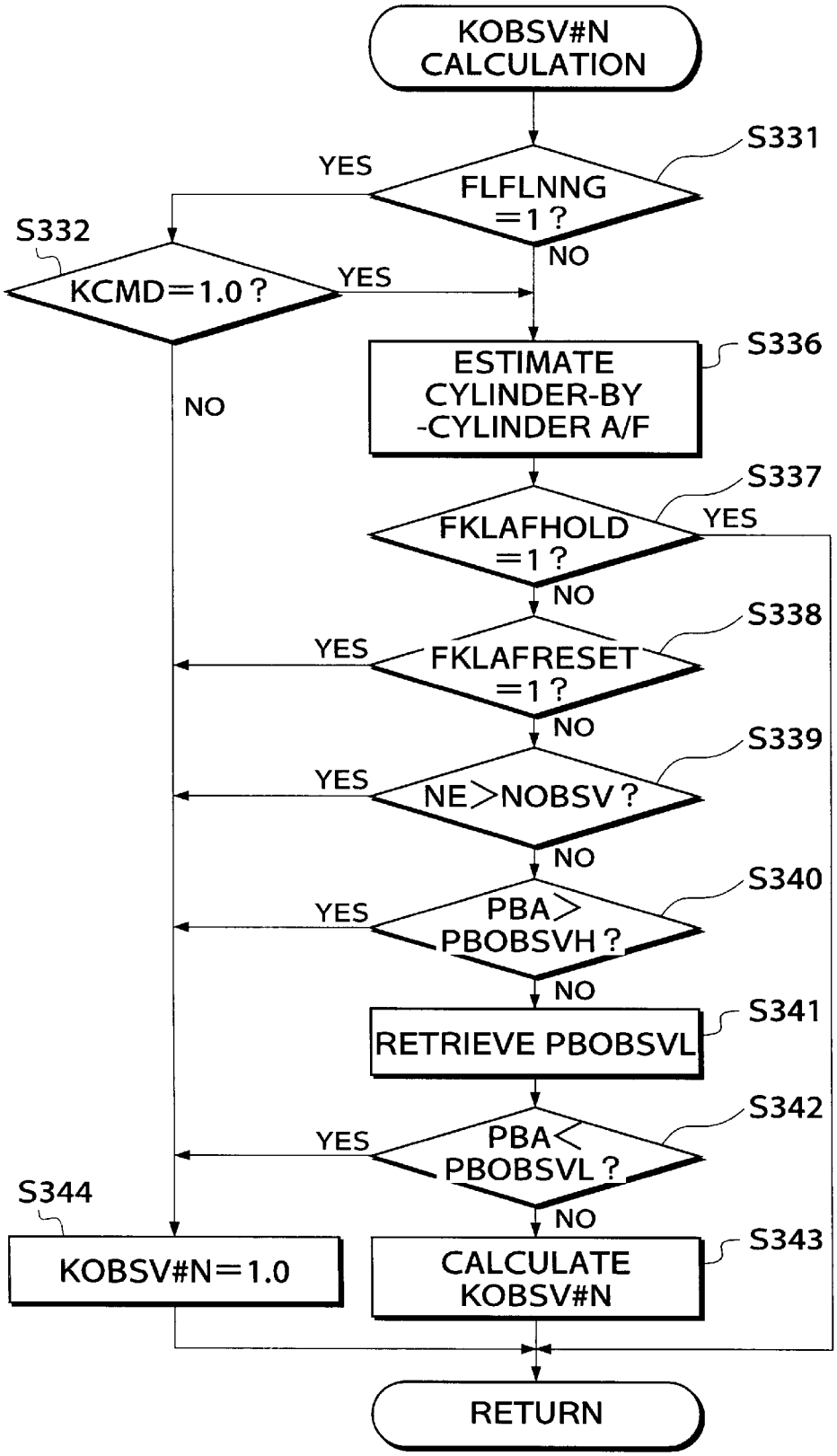
FIG. 14 is a flowchart showing a subroutine for calculating the cylinder-by-cylinder correction coefficient KOBSV#N, which is executed at a step S9 in FIG. 3.

FIG. 14 shows a subroutine for calculating the cylinder-by-cylinder correction coefficient KOBSV#N, which is executed at the step S9 in FIG. 3.

First, at a step S331, it is determined whether or not lean output deterioration of the LAF sensor 17 has been detected, and if the lean output deterioration has not been detected, the program proceeds to a step S336. On the other hand, if the lean output deterioration has been detected, it is determined at a step S332 whether or not the desired equivalent ratio KCMD is equal to 1.0, i.e. whether or not the desired air-fuel ratio assumes the stoichiometric air-fuel ratio. The lean output deterioration of the LAF sensor means such a deterioration of the LAF sensor that the output from the LAF sensor exhibited when the air-fuel ratio of the mixture is actually controlled to a leaner air-fuel ratio than the stoichiometric value deviates from a proper value by an amount larger than a predetermined amount. If KCMD=1.0 holds, the program proceeds to the step S336, whereas if KCMD≠1.0 holds, the cylinder-by-cylinder correction coefficient KOBSV#N for all the cylinders is set to 1.0 at a step S344, which means that the cylinder-by-cylinder feedback control is not executed, followed by terminating the present routine.

At the S336, the cylinder-by-cylinder air-fuel ratio estimation by the observer described above is executed. Then, it is determined at a step S337 whether or not a hold flag FKLAFHOLD which, when set to "1", indicates that the PID correction coefficient KLAF should be held at the present value, assumes "1". If FKLAFHOLD=1 holds, the program is immediately terminated.

Figure 16:
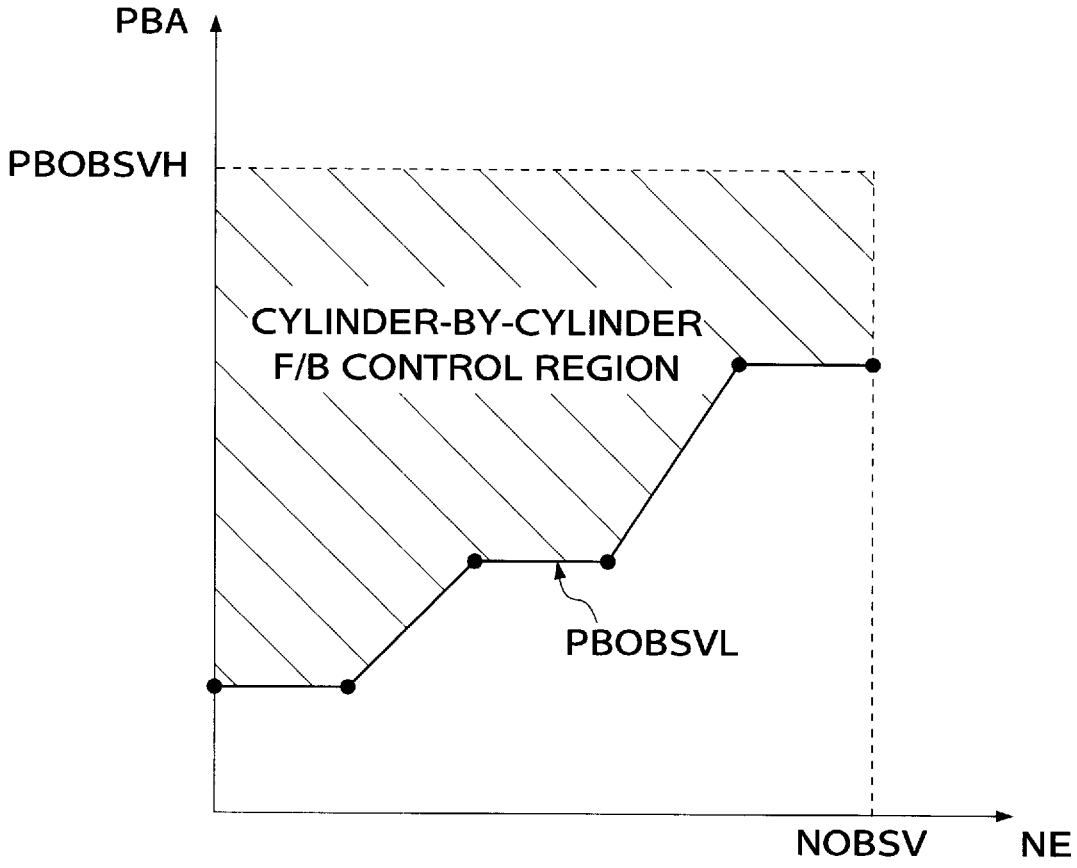
FIG. 16 is a diagram which is useful in explaining a cylinder-by-cylinder feedback control region.

If FKLAFHOLD=0 holds at the step S337, it is determined at a step S338 whether or not the reset flag FKLAFRESET assumes "1". If FKLAFRESET=0 holds, it is determined at a step S339 whether or not the engine rotational speed NE is higher than a predetermined value NOBSV (e.g. 3500 rpm). If NE≦NOBSV holds, it is determined at a step S340 whether or not the intake pipe absolute pressure PBA is higher than a predetermined upper limit value PBOBSVH (e.g. 650 mmHg). If PBA≦PBOBSVH holds, a PBOBSVL table which is set according to the engine rotational speed NE, as shown in FIG. 16, is retrieved to determine a lower limit value PBOBSVL of the PBA value at a step S341, and then it is determined at a step S342 whether or not the PBA value is lower than the lower limit value PBOBSVL.

If any of the answers to the questions of the steps S338 to S340 and S342 is affirmative (YES), the program proceeds to the step S344, and therefore the cylinder-by-cylinder air-fuel ratio feedback control is not executed. On the other hand, if the answers to the questions of the steps S338 to S340 and S342 are all negative (NO), which means that the engine is in a operating condition corresponding to the shaded region in FIG. 16, it is determined that the cylinder-by-cylinder air-fuel ratio feedback control can be carried out. Therefore, the cylinder-by-cylinder correction coefficient KOBSV#N is calculated in the manner as described above at a step S343, followed by terminating the present program.

Figure 15:
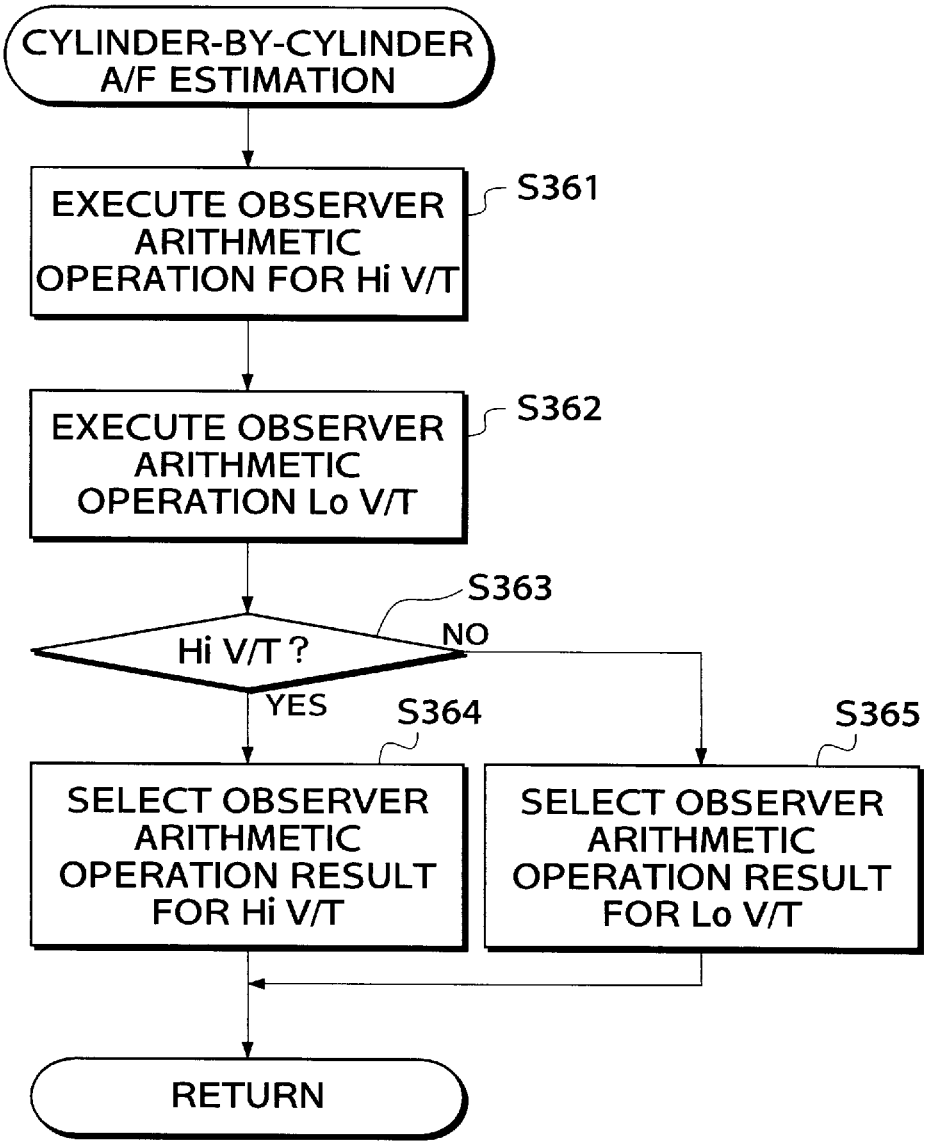
FIG. 15 is a flowchart showing a subroutine for carrying out a cylinder-by-cylinder air-fuel ratio-estimating process, which is executed at a step S336 in FIG. 14.

FIG. 15 shows a subroutine for estimating the cylinder-by-cylinder air-fuel ratio, which is executed at the step S336 in FIG. 14.

First, at a step S361, an arithmetic operation by the use of the observer (i.e. estimation of the cylinder-by-cylinder air-fuel ratio value) for the high-speed valve timing is carried out, and at the following step S362, an arithmetic operation by the use of the observer for the low-speed valve timing is carried out. Then, it is determined at a step S363 whether or not the present valve timing is set to the high-speed valve timing. If the present valve timing is set to the high-speed valve timing, a result of the observer arithmetic operation for the high-speed valve timing is selected at a step S364, whereas if the present valve timing is set to the low-speed valve timing, a result of the observer arithmetic operation for the low-speed valve timing is selected at a step S365.

The reason why the observer arithmetic operations for the high-speed valve timing and the low-speed valve timing are thus carried out before determining the present valve timing is that the estimation of the cylinder-by-cylinder air-fuel ratio requires several times of arithmetic operations before the estimation results are converged. By the above manner of estimation, it is possible to enhance the accuracy of estimation of the cylinder-by-cylinder air-fuel ratio immediately after changeover of the valve timing.

Next, description will be made of a second embodiment of the invention.

In the second embodiment, the cylinder-by-cylinder fuel-air ratio is calculated by the use of the following equation (16) in place of the equations (10) and (11) employed in the first embodiment described above. That is, while in the first embodiment the estimated value yΛ(k) of the fuel-air ratio at the confluent portion containing the response delay of the LAF sensor is introduced in the fourth-order observer (which observes four fuel-air ratios for the four cylinders). On the other hand, in the present embodiment, the cylinder-by-cylinder fuel-air ratio is estimated by a fifth-order observer which also observes the estimated value yΛ(k) of the fuel-air ratio at the confluent portion (i.e. observes four fuel-air ratios for the four cylinders plus the fuel-air ratios at the confluent portion), which is expressed by the following equation (16):

$$\hat{X}'(k+1)=A'\hat{X}'(k)+K'(y(k)-C'\hat{X}'(k)) \tag{16}$$

where $$\hat{X}'(k)=\begin{bmatrix}\hat{x}(k-3)\\ \hat{x}(k-2)\\ \hat{x}(k-1)\\ \hat{x}(k)\\ \hat{y}(k)\end{bmatrix}$$

$$A'=\begin{bmatrix}0 & 1 & 0 & 0 & 0\\ 0 & 0 & 1 & 0 & 0\\ 0 & 0 & 0 & 1 & 0\\ 1 & 0 & 0 & 0 & 0\\ (1-DL)C_1 & (1-DL)C_2 & (1-DL)C_3 & (1-DL)C_4 & DL\end{bmatrix}$$

$$K'=\begin{bmatrix}K_1\\ K_2\\ K_3\\ K_4\\ K_5\end{bmatrix}$$

$$C'=[(1-DL)C_1\ (1-DL)C_2\ (1-DL)C_3\ (1-DL)C_4\ DL]$$

In the above equation (16), DL represents the time constant of the response delay of the LAF sensor 17, which is set according to the engine rotational speed NE and the intake pipe absolute pressure PBA, similarly to the first embodiment. In the present embodiment, the gain vector K' is also set at least according to the engine rotational speed NE. In this regard, it is desirable that the engine rotational speed region is divided into a plurality of regions, and a plurality of observers with different values of the time constant DL and the gain vector K' are provided for the respective divided regions, to thereby select one of the observers depending on the detected engine rotational speed NE.

Except for those described above, the second embodiment is identical with the first embodiment, and therefore description thereof is omitted.

In the present embodiment as well, the fuel-air ratio at the confluent portion containing the response delay of the LAF sensor 17 is estimated, and the cylinder-by-cylinder air-fuel ratio is estimated based on the thus estimated fuel-air ratio at the confluent portion, thus accurately estimating the cylinder-by-cylinder air-fuel ratio. Further, according to the present embodiment, by virtue of the fifth-order observer, by properly setting the gain vector K', the cylinder-by-cylinder air-fuel ratio can be more stably and promptly converged to the desired air-fuel ratio than by the fourth-order observer of the first embodiment, thus achieving improved response of the observer.

The invention may be applied to a V-type 6-cylinder internal combustion engine in which a confluent portion of the exhaust system is provided for each of two banks of cylinders, with a LAF sensor arranged at each confluent-portion. In this case, the three cylinders of each bank have their air-fuel ratios estimated based on a single LAF sensor. Therefore, a fourth-order observer is employed, which observes three fuel-air ratios for the three cylinders plus the fuel-air ratio at the confluent portion of the exhaust system.

Next, description will be made of a third embodiment of the invention. The second embodiment has the same hardware construction as that shown in FIG. 1 as well as the same main routine shown in FIG. 3 for calculating the desired air-fuel ratio correction coefficient KLAF, employed in the first embodiment, but is different from the latter in that the LAF sensor output-selecting process and the KOBSV#N-calculating process are executed by routines shown in FIG. 17 and FIG. 21. Therefore, description will be made only of these different processes.

Figure 17:
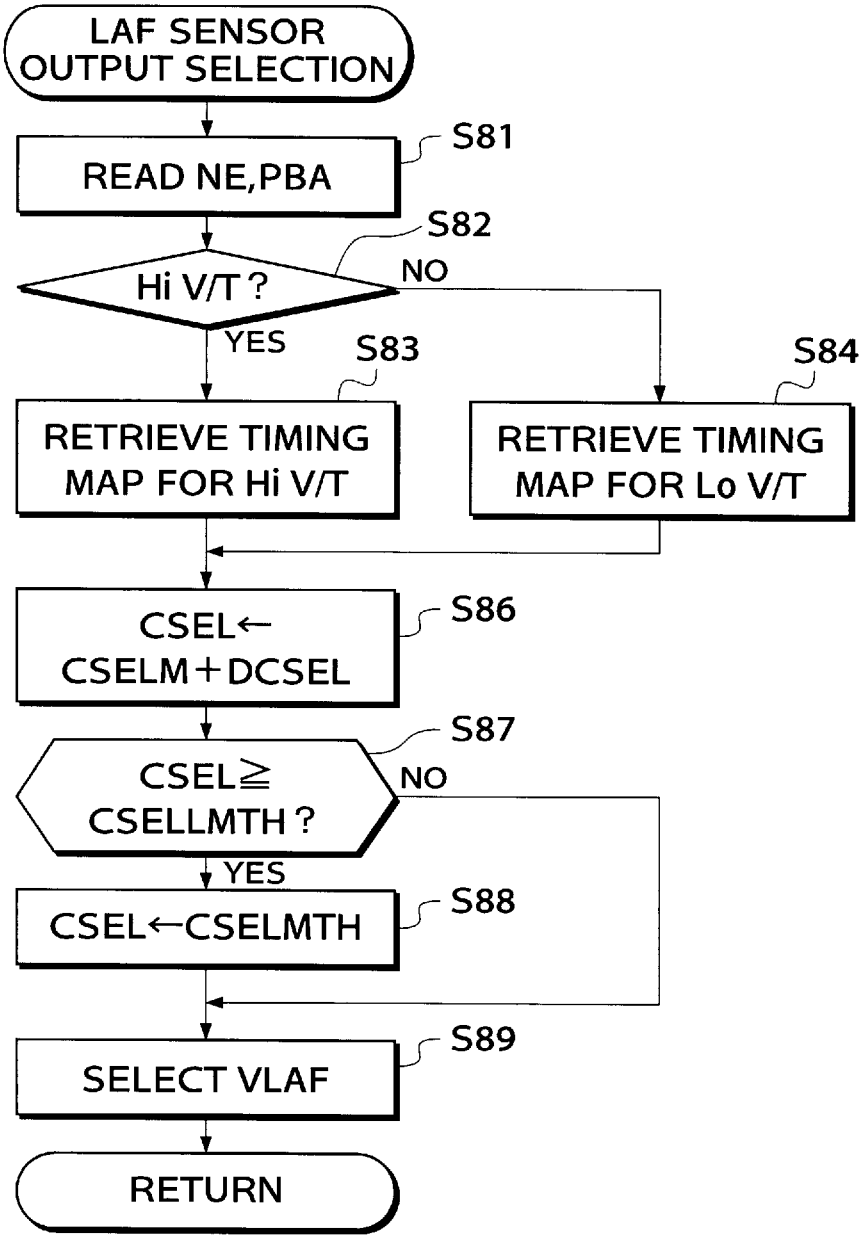
FIG. 17 is a flowchart showing a subroutine for selecting the LAF sensor output value, which is executed at the step S3 in FIG. 3, according to a third embodiment of the invention.

FIG. 17 shows the LAF sensor output-selecting process according to the third embodiment. In this process, the steps S81 and S82 are identical with those of the FIG. 7 process, description thereof being omitted.

If it is determined at the step S82 that the present valve timing is set to the high-speed valve timing, a timing map suitable for the high-speed valve timing is retrieved to obtain a map value CSELM indicative of desired sampling timing at a step S83. On the other hand, if the present valve timing is set to the low-speed valve timing, a timing map suitable for the low-speed valve timing is retrieved to obtain the map value CSELM at a step S84. As the map value CSELM, one of values from 0 to 17 is selected according to the present embodiment (see FIG. 6). Then, a sampling timing correction amount DCSEL is added to the above obtained map value CSELM, to thereby calculate a sampling timing value CSEL at a step S86. The sampling timing correction amount DCSEL is set according to a parameter TLAF representative of a degree of deterioration of the response characteristic of the LAF sensor 17, as well as the sampling timing value CSEL.

At the following step S87, it is determined whether or not the calculated sampling timing value CSEL is equal to or larger than a predetermined upper limit value CSELLMTH. If CSEL<CSELLMTH holds, the program skips over a step S88 to a step S89. On the other hand, if CSEL≧CSELLMTH holds, the CSEL value is set to the upper limit value CSELLMTH at the step S88, followed by the program proceeding to the step S89.

At the step S89, an output value VLAF of the LAF sensor corresponding to the calculated CSEL value is selected from the output values VLAF stored in the ring buffer, followed by terminating the present routine. The sampling timing value CSEL can assume a negative value depending upon the correction by the correction amount DCSEL. In such a case, a sample value corresponding to the sample timing value CSEL=0 is selected, and the estimation of the cylinder-by-cylinder air-fuel ratio is terminated, as described hereinafter.

The timing maps retrieved at the steps S83 and S84 are set similarly to the timing maps of the first embodiment, i.e. as shown in FIGS. 8, 9A and 9B.

According to the process of FIG. 17, in addition to the excellent results obtained by the first embodiment described with respect to FIG. 7, it is possible to always use the output value VLAF sampled at the optimum timing over a prolonged time period, by virtue of the correction of the sampling timing according to the deterioration parameter TLAF representative of the degree of response deterioration of the LAF sensor 17.

Figure 18:
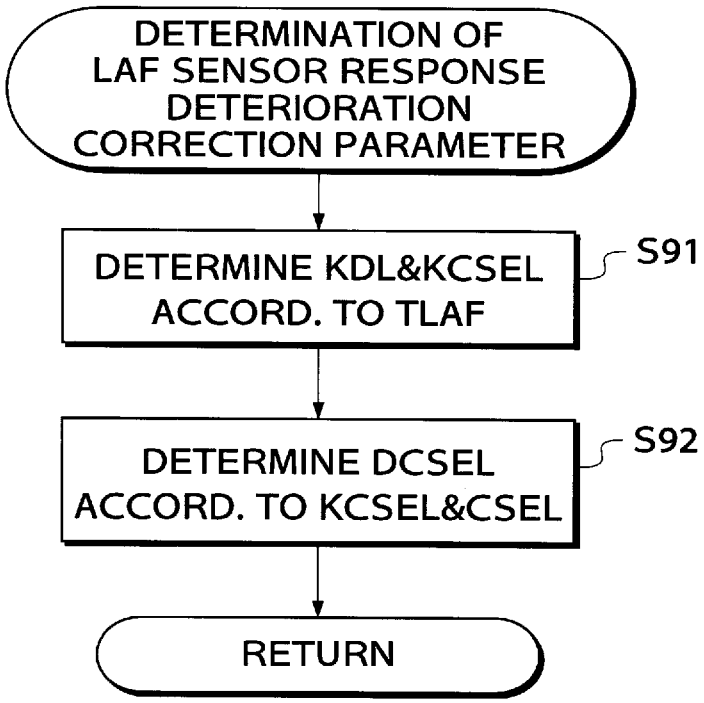
FIG. 18 is a flowchart showing a subroutine for calculating a sampling timing correction amount DCSEL, etc., according to a deterioration parameter TLAF of the LAF sensor.

FIG. 18 shows a subroutine for calculating correction parameters, such as the sampling timing correction amount DCSEL, according to the deterioration parameter TLAF representative of the degree of response deterioration of the LAF sensor 17. This subroutine is executed in synchronism with generation of TDC signal pulses.

Figure 19A:
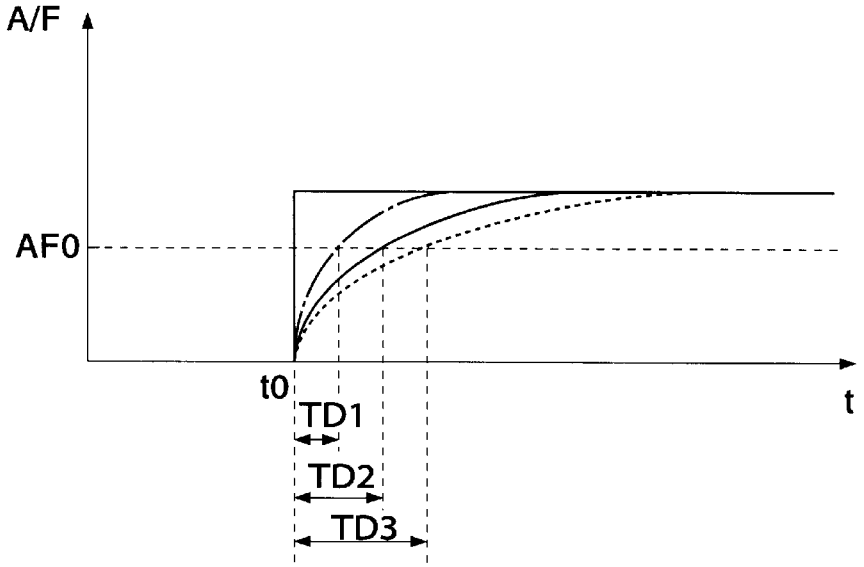
FIG. 19A is a graph for determining a time period TD within which the output from the LAF sensor assumes a value corresponding to a stoichiometric air-fuel ratio.
Figure 19B:
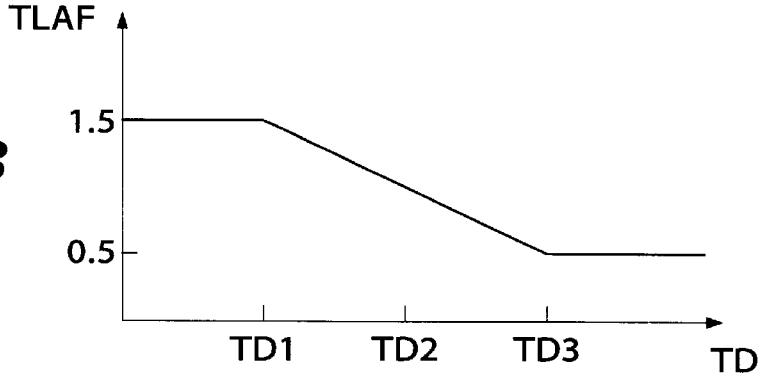
FIG. 19B shows a table for determining the deterioration parameter TLAF, which is used in the FIG. 18 process.

Before description of the FIG. 18 process is made, first, a manner of determining the deterioration parameter TLAF will be described with reference to FIGS. 19A and 19B.

When the operating condition of the engine shifts, for example, from a region where the desired air-fuel ratio assumes the stoichiometric value to a region where fuel cut is effected, a time period TD (e.g. TD1, TD2, TD3 shown in FIG. 19A) is measured, within which the LAF sensor output VLAF changes to a value corresponding to a predetermined air-fuel ratio AFO (e.g. A/F=30) after a time point t0 of starting the fuel cut. Then, a table shown in FIG. 19B is retrieved according to the thus measured time period TD, to determine the deterioration parameter TLAF. When the LAF sensor is deteriorated, the response time becomes either longer or shorter. Therefore, according to the present embodiment, the value TD2 is used as a reference value of the TD value, i.e. a value assumed by the LAF sensor at the time of newly using the same.

Figure 20A:
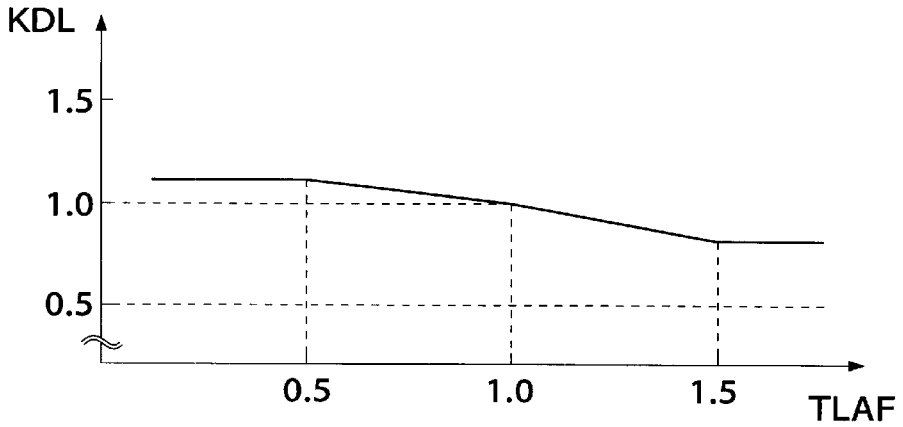
FIG. 20A shows a table for determining a time constant correction coefficient KDL, which is for use in the FIG. 18 process.
Figure 20B:
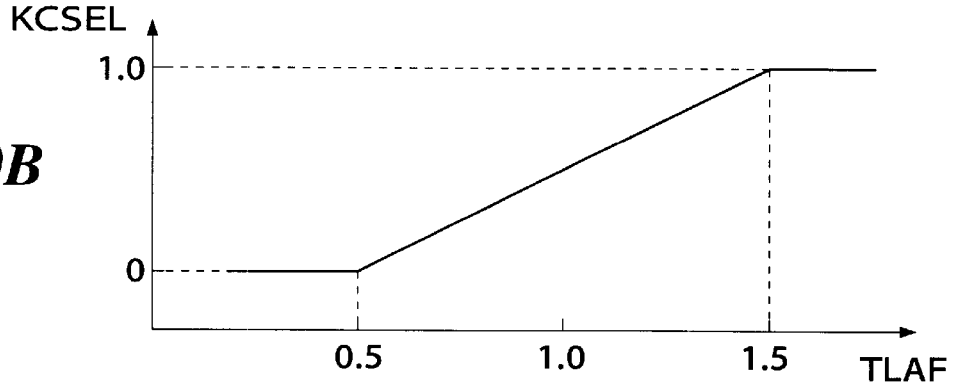
FIG. 20B shows a table for determining a calculating parameter KCSEL according to the TLAF value, which is used in the FIG. 18 process.

Referring again to FIG. 18, at a step S91, a response delay time constant correction coefficient KDL and a calculating parameter KCSEL for calculating the sampling timing correction amount DCSEL at a step S92 are determined according to the deterioration parameter TLAF. More specifically, a KDL table shown in FIG. 20A and a KCSEL table shown in FIG. 20B are retrieved according to the TLAF value, to determine the KDL value and the KCSEL value, respectively. According to the tables, the KDL value is set to a smaller value as the TLAF value increases, while the KCSEL value is set to a larger value as the TLAF value increases. The response delay time constant correction coefficient KDL is used for correcting the response delay time constant DL by a subroutine of FIG. 22.

Figure 20C:
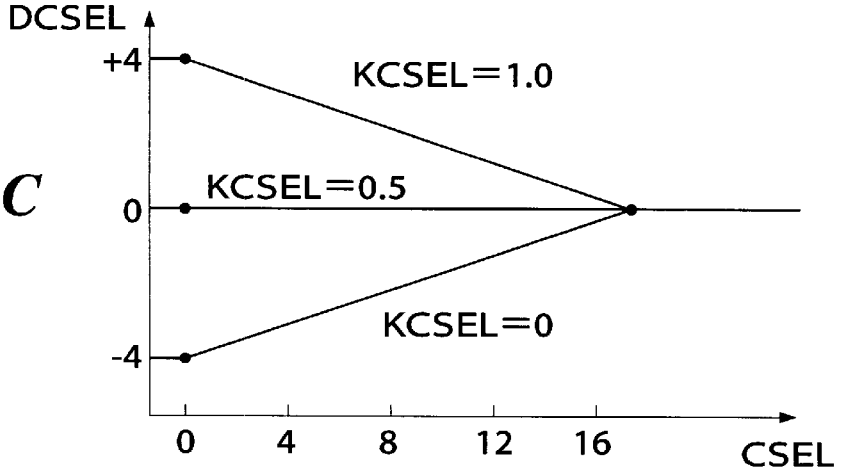
FIG. 20C shows a table for determining the sampling timing correction amount DCSEL, which is used in the FIG. 18 process.

Then, at the step S92, a DCSEL table shown in FIG. 20C is retrieved according to the calculating parameter KCSEL and the sampling timing value CSEL, to determine the sampling timing correction amount DCSEL. If the KCSEL value assumes a value other than those shown in the table, an interpolation is executed to determine the DCSEL value. According to the DCSEL table shown in FIG. 20C, the DCSEL value is set such that the absolute value thereof is decreased as the sampling timing value CSEL increases, i.e. the sampling timing becomes earlier, while the DCSEL value is set to a larger value as the KCSEL value increases. When the KCSEL value falls within a range of $0<KCSEL<0.5$, the DCSEL value is set to a negative value, which corresponds to a case where the response time of the LAF sensor becomes longer than the initial value, i.e. the response of the LAF sensor becomes delayed due to deterioration thereof.

Next, description will be made of a manner of calculating the cylinder-by-cylinder correction coefficient KOBSV#N with reference to a subroutine shown in FIG. 21, which is executed at the step S9 in FIG. 3.

In this connection, the manner of estimating the cylinder-by-cylinder air-fuel ratio by the observer is identical with the manner in the first embodiment, description of which is omitted.

Figure 21:
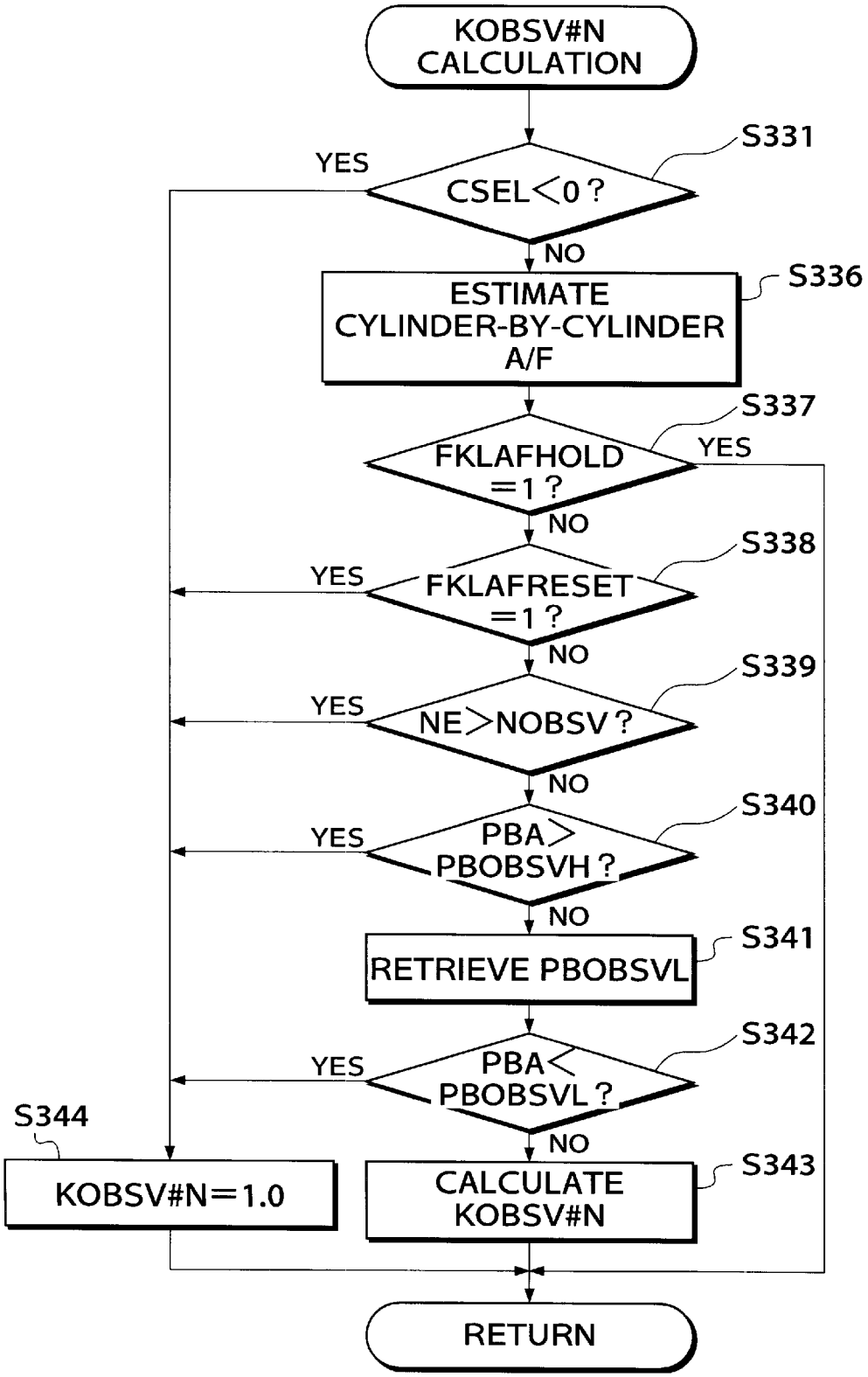
FIG. 21 is a flowchart showing a subroutine for calculating the cylinder-by-cylinder correction coefficient KOBSV#N, which is executed at the step S9 in FIG. 3, according to the third embodiment.

First, at a step S331*a* in FIG. 21, it is determined whether or not the sampling timing value CSEL is negative or not, and if CSEL<0 holds, the cylinder-by-cylinder correction coefficient KOBSV#N of each cylinder is set to 1.0 at a step S344, to inhibit execution of the cylinder-by-cylinder feedback control, similarly to the the step S344 in FIG. 14, followed by terminating the present routine. As shown in FIG. 6, the CSEL value assumes "0" at the newest (latest) timing, and as the CSEL value increases, a LAF sensor output value sampled at older (earlier) timing is to be selected. That is, there is no sample data corresponding to a negative value of the CSEL value, and therefore, to avoid degraded estimation accuracy of the cylinder-by-cylinder air-fuel ratio, the cylinder-by-cylinder correction coefficient KOBSV#N is set to 1.0 at the step S344, followed by terminating the present routine.

If the answer to the question of the step S331*a* is negative (NO), the program proceeds to a step S336, wherein the estimation of the cylinder-by-cylinder air-fuel ratio by the observer is executed. Steps S337 to S344 are identical with those in FIG. 14, and therefore description thereof is omitted.

Figure 22:
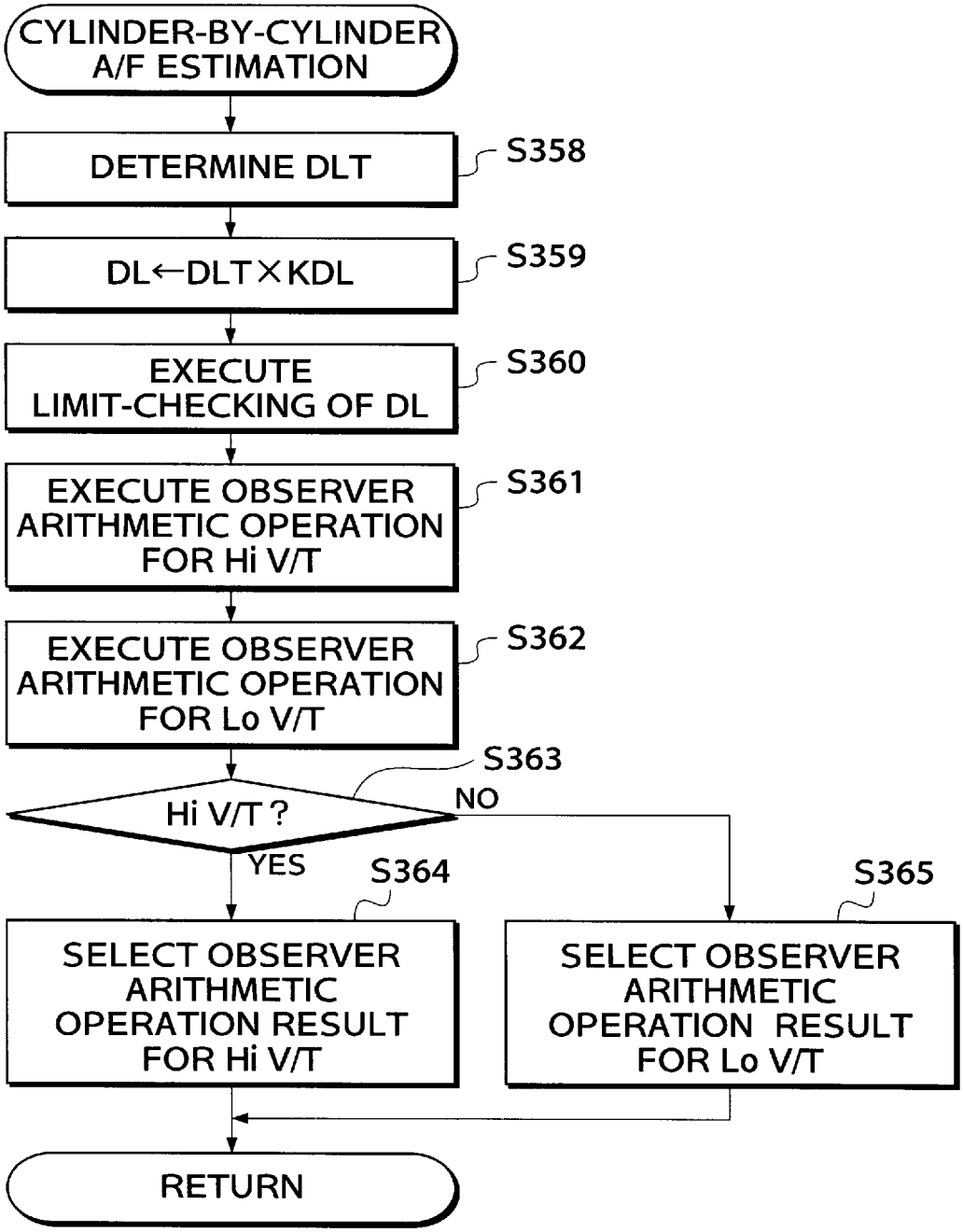
FIG. 22 is a flowchart showing a subroutine for estimating the air-fuel ratio of each of the cylinders, which is executed at a step S336 in FIG. 21.

FIG. 22 shows a subroutine for estimating the cylinder-by-cylinder air-fuel ratio, which is executed at the step S336 in FIG. 21.

First, at a step S358, the DL table shown in FIG. 12 is retrieved to determine a table value DLT of the response delay time constant DL. Then, at a step S359 the table value DLT is multiplied by the time constant correction coefficient KDL for correction thereof, to calculate the response delay time constant DL. Then, limit checking of the calculated DL value is executed at a step S360, wherein the DL value is corrected so as to fall within a predetermined range if it falls outside the predetermined range, followed by the program proceeding to the step 361 et seq.

The response delay time constant DL thus corrected by the deterioration parameter TLAF for the response deterioration of the LAF sensor is used in the estimation of the cylinder-by-cylinder air-fuel ratio by steps S361 to S365, in a similar manner to the first embodiment described before.

The steps S361 to S365 of FIG. 22 are identical with those in FIG. 18 in the first embodiment, and therefore description thereof is omitted.

As described hereinabove, according to the present embodiment, the sampling timing value CSEL and the response delay time constant DL applied by the observer are corrected according to the deterioration parameter TLAF representative of the response deterioration of the LAF sensor. As a result, even if the output characteristic of the LAF sensor changes due to aging, the cylinder-by-cylinder air-fuel ratio can be accurately estimated, to thereby maintain good estimation accuracy of the cylinder-by-cylinder air-fuel ratio over a prolonged time.

What is claimed is:

1. In a cylinder-by-cylinder air-fuel ratio-estimating system for an internal combustion engine having a plurality of cylinders, and an exhaust system including at least one confluent portion, the cylinder-by-cylinder air-fuel ratio-estimating system including air-fuel ratio-detecting means arranged in said exhaust system at said confluent portion, and cylinder-by-cylinder air-fuel ratio-estimating means for estimating an air-fuel ratio of a mixture supplied to each of said cylinders, based on an output from said air-fuel ratio-detecting means, by using an observer for observing an internal operative state of said exhaust system based on a model representative of a behavior of said exhaust system, the improvement wherein:

said cylinder-by-cylinder air-fuel ratio-estimating means includes confluent portion air-fuel ratio-estimating means for estimating an air-fuel ratio at said confluent portion of said exhaust system by using a delay parameter representative of a response delay of said air-fuel ratio-detecting means, said cylinder-by-cylinder air-fuel ratio-estimating means estimating said air-fuel ratio of said mixture supplied to said each of said cylinders by using an output from said confluent portion air-fuel ratio-estimating means, said estimated air-fuel ratio of said mixture supplied to said each of said cylinders being subsequently used for estimating a value of said air-fuel ratio at said confluent portion of said exhaust system.

2. A cylinder-by-cylinder air-fuel ratio-estimating system as claimed in claim 1, wherein said cylinder-by-cylinder air-fuel ratio-estimating means estimates said air-fuel ratio of said mixture supplied to said each of said cylinders, based on a difference between said output from said air-fuel ratio-detecting means and said output from said confluent portion air-fuel ratio-estimating means.

3. A cylinder-by-cylinder air-fuel ratio-estimating system as claimed in claim 1, wherein said observer of said cylinder-by-cylinder air-fuel ratio-estimating means observes an air-fuel ratio of an air-fuel mixture supplied to ones of said cylinders connected to said confluent portion of said exhaust system and said air-fuel ratio at said confluent portion of said exhaust system.

4. A cylinder-by-cylinder air-fuel ratio-estimating system as claimed in any of claims 1 to 3, wherein said confluent portion air-fuel ratio-estimating means estimates said air-fuel ratio at said confluent portion by using a delay time constant as said delay parameter, said delay time constant being set according to at least rotational speed of said engine.

5. In a cylinder-by-cylinder air-fuel ratio-estimating system for an internal combustion engine having a plurality of cylinders, a crankshaft, and an exhaust system including at least one confluent portion, the cylinder-by-cylinder air-fuel ratio-estimating system including air-fuel ratio-detecting means arranged in said exhaust system at said confluent portion, and cylinder-by-cylinder air-fuel ratio-estimating means for estimating an air-fuel ratio of a mixture supplied to each of said cylinders, based on an output from said air-fuel ratio-detecting means, by using an observer for observing an internal operative state of said exhaust system based on a model representative of a behavior of said exhaust system, the improvement comprising:

sampling means for sampling said output from said air-fuel ratio-detecting means whenever said crankshaft rotates through predetermined rotational degrees, and sequentially storing sampled output values obtained by said sampling;

selecting means for determining a value of sampling timing according to operating conditions of said engine, and selecting one of the stored sampled output values corresponding to said determined value of sampling timing;

deterioration parameter-calculating means for calculating a deterioration parameter representative of deterioration of a response characteristic of said air-fuel ratio-detecting means; and delay parameter-calculating means for calculating a delay parameter representative of a response delay of said air-fuel ratio-detecting means;

said selecting means correcting said value of sampling timing according to said deterioration parameter;

said cylinder-by-cylinder air-fuel ratio-estimating means including confluent portion air-fuel ratio-estimating means for estimating an air-fuel ratio at said confluent portion of said exhaust system by using said delay parameter, said cylinder-by-cylinder air-fuel ratio-estimating means estimating said air-fuel ratio of said mixture supplied to said each of said cylinders by using an output from said confluent portion air-fuel ratio-estimating means;

said confluent portion air-fuel ratio-estimating means correcting said delay parameter according to said deterioration parameter.

6. A cylinder-by-cylinder air-fuel ratio-estimating system as claimed in claim 5, wherein said selecting means calculates a correcting amount of said value of sampling timing according to said deterioration parameter and said sampling timing.

7. A cylinder-by-cylinder air-fuel ratio-estimating system as claimed in claim 5, including inhibiting means for inhibiting said cylinder-by-cylinder air-fuel ratio-estimating means from estimating said air-fuel ratio of said mixture supplied to said each of said cylinders when none of said sampled output values stored by said sampling means correspond to said value of sampling timing corrected according to said deterioration parameter by said selecting means.

* * * * *